US006913876B2

(12) United States Patent
Kobayashi

(10) Patent No.: US 6,913,876 B2
(45) Date of Patent: Jul. 5, 2005

(54) PHOTOTHERMOGRAPHIC MATERIAL

(75) Inventor: Yasunobu Kobayashi, Hino (JP)

(73) Assignee: Konica Corporation, Tokyo (JP)

( * ) Notice: Subject to any disclaimer, the term of this patent is extended or adjusted under 35 U.S.C. 154(b) by 0 days.

(21) Appl. No.: 10/627,205

(22) Filed: Jul. 24, 2003

(65) Prior Publication Data

US 2004/0033453 A1 Feb. 19, 2004

(30) Foreign Application Priority Data

Aug. 8, 2002 (JP) ..... 2002-231170

(51) Int. Cl.[7] ..... G03C 1/498

(52) U.S. Cl. ..... 430/523; 430/264; 430/351; 430/598; 430/619; 206/389; 206/497

(58) Field of Search ..... 430/619, 531, 430/264, 598, 523; 206/389, 455, 497

(56) References Cited

U.S. PATENT DOCUMENTS 6,140,038 A * 10/2000 Ishizuka et al. ..... 430/619

6,524,781 B2 * 2/2003 Wada ..... 430/523

FOREIGN PATENT DOCUMENTS

| | | | |
|---|---|---|---|
| EP | 0 990 947 A1 | | 4/2000 |
| EP | 1 136 877 A2 | | 9/2001 |
| JP | 11-133551 | * | 5/1999 |
| JP | 2001-013632 | * | 1/2001 |

* cited by examiner

*Primary Examiner*—Thorl Chea
(74) *Attorney, Agent, or Firm*—Frishauf, Holtz, Goodman & Chick, P.C.

(57) ABSTRACT

A photothermographic material is disclosed, comprising a support, an organic silver salt, a light-sensitive silver halide, a reducing agent and a contrast-increasing agent, wherein the photothermographic material further comprises a secondary or tertiary amino group-containing alkoxysilane compound and a polyethyleneimine. A light-shielding package of the photothermographic material is also disclosed.

10 Claims, 1 Drawing Sheet

PHOTOTHERMOGRAPHIC MATERIAL

FIELD OF THE INVENTION

The present invention relates to a photothermographic material, package of the photothermographic material in roll and a preparation method of a package of the photothermographic material in roll.

BACKGROUND OF THE INVENTION

In the field of graphic arts and medical treatment, there have been concerns in processing of photographic film with respect to effluents produced from wet-processing of image forming materials, and recently, reduction of the processing effluent is strongly demanded in terms of environmental protection and saving space. There has been desired a photothermographic material for photographic use, capable of forming distinct black images exhibiting high sharpness, enabling efficient exposure by means of a laser imager or a laser image setter.

Thermally developable photothermographic materials are disclosed, for example, in D. Morgan and B. Shely, U.S. Pat. Nos. 3,152,904 and 3,457,075, and D. H. Klosterboer, "Thermally Processed Silver Systems" (Imaging Processes and Materials, Neblette, 8th Edition, edited by J. M. Sturge, V. Walworth, and A. Shepp, page 2, 1969), etc. Such photothermographic materials contain a reducible light-insensitive silver source (such as organic silver salts), a catalytically active amount of photocatalyst (such as silver halide) and a reducing agent, which are dispersed in a binder matrix. Such photothermographic materials are stable at ordinary temperature and forms silver upon heating, after exposure, at a relatively high temperature through an oxidation-reduction reaction between the reducible silver source (which functions as an oxidizing agent) and the reducing agent. The oxidation-reduction reaction is accelerated by the catalytic action of a latent image produced by exposure. Silver formed through reaction of the reducible silver salt in exposed areas produces a black image, which contrasts with non-exposed areas, leading to image formation.

Such photothermographic materials, for example, are cut to a given width and wound onto a roll core to form a rolled photothermographic material (photothermographic material in roll). Then, a light-shielding leader of a relatively low moisture permeability is attached to the top of the photothermographic material in roll and wound around the circumferential of the photothermographic material in roll, which is further packed with a light-shielding material to form a room-light loading type photothermographic material package that can be loaded into an image recording device under room-light (hereinafter, also denoted simply as a package).

Since organic silver salts are employed as a silver source in the photothermographic material, in cases when moisture is contained in the photothermographic material, the moisture promotes dissociation of silver ions from the organic silver salt, causing reaction with the reducing agent to produce fog during storage of raw photothermographic material and resulting in contrast variation.

In order to enhance pre-exposure storage stability of a photothermographic material, various countermeasures have been taken in both photothermographic materials and a packing methods thereof. As one countermeasure from the photothermographic material side, for example, JP-A No. 6-301140 (hereinafter, the term, JP-A refers to a Japanese Patent Application Publication) discloses a technique of keeping the residual solvent content after coating at a prescribed level, thereby minimizing aging variations in developing temperature or density; JP-A No. 2000-310830 discloses a photothermographic material, in which a support exhibiting an equilibrium moisture content at 60% RH of 0.5 wt % or less and further thereon, a coating solution having a water content of 2 wt % or less is coated and dried so that the dried photothermographic material exhibits a residual solvent content of 2.0 wt % or less; and JP-A No. 11-352623 discloses a technique of packaging at 20 to 60% RH. There is also disclosed in JP-A No. 2000-206653 a technique of packing photothermographic materials with packing material exhibiting an oxygen permeability of 50 ml/atm·$m^2$·25° C.·day or less and a moisture permeability of 10 g/atm·$m^2$·25° C.·day or less.

However, it is a proven fact that reducing the solvent content of photothermographic material or packing photothermographic material with a packing material exhibiting a low moisture permeability under a relatively low humidity is insufficient to prevent fogging or variation in image quality, caused during storage of raw photothermographic material. In fact, complicated and troublesome controls, such as refrigerated storage or storage in an atmosphere maintained at a given humidity have been conducted to maintain photographic performance following storage of pre-exposure photothermographic material. Accordingly, there is desired development of a photothermographic material having no necessity of such troublesome control and exhibiting superior raw stock stability, and a package thereof.

SUMMARY OF THE INVENTION

Accordingly, the present invention has been achieved in light of the foregoing circumstances. Thus, it is an object of this invention to provide a photothermographic material exhibiting minimized fogging and contrast variation, caused during pre-exposure storage, a package of a photothermographic material rolled on a light-shielding core, and a preparation method thereof.

The foregoing object of the invention can be accomplished by the following constitution:

(1) A photothermographic material comprising on a support an organic silver salt, a light-sensitive silver halide, a reducing agent and a contrast-increasing agent, wherein the photothermographic material further comprises a secondary or tertiary amino group-containing alkoxysilane compound and a polyethyleneimine;

(2) The photothermographic material described above, wherein the alkoxysilane compound is represented by the following formula (1a) or (1b):

Formula (1a)

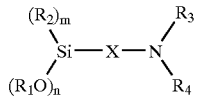

Formula (1b)

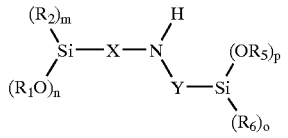

wherein X and Y are each a straight chain or branched bivalent saturated hydrocarbon group having 1 to 10 carbon atoms; $R_1$, $R_2$, $R_5$ and $R_6$ are each a straight chain or branched saturated hydrocarbon group having 1 to 4 carbon atoms; $R_3$ and $R_4$ are each a hydrogen atom, an aliphatic group having 1 to 20 carbon atoms or an aromatic group, provided that at least one of $R_3$ and $R_4$ is an aliphatic group having 1 to 20 carbon atoms or an aromatic group, and $R_3$ and $R_4$ may combine with each other to form a ring; m and o are each 0 or 1, n and p are each 2 or 3.

(3) A package of a rolled photothermographic material, wherein the package comprises a rolled photothermographic material in which a photothermographic material as claimed in any of claims 1 to 5 is wound on a light-shielding roll core, a light-shielding flange member provided at both ends of the roll core and a light-shielding leader which is attached to the top of the photothermographic material and has a width greater than that of the rolled photothermographic material and a prescribed length of the light-shielding leader is wound around the rolled photothermographic material with covering a circumferential portion of the flange so that light-shielding is performed with maintaining an internal absolute humidity at 4 to 17 g/m$^2$ under an environment of 10 to 25° C.

DETAILED DESCRIPTION OF THE INVENTION

Figure 1:
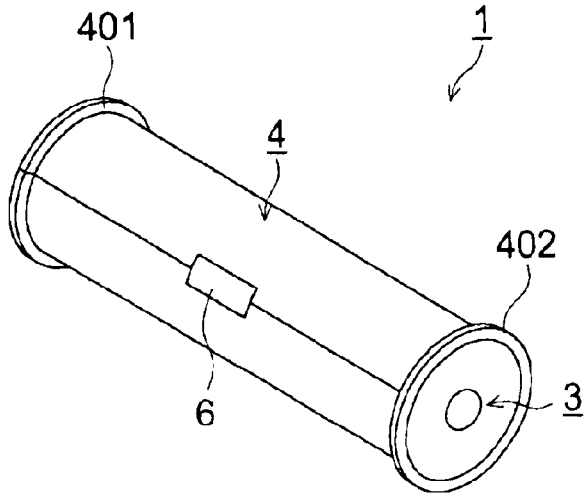
FIG. 1 illustrates a package of a rolled photothermographic material according to the invention.

The photothermographic material according to this invention comprises on one side of a support an image forming layer containing an organic silver salt, a light-sensitive silver halide, a reducing agent and optionally matting agent and a protective layer on the image forming layer, and on the opposite side of the support from the image forming layer, a backing layer to enhance transportability and prevent blocking with the protective layer and further thereon, a backing protective layer. There may be provided a sublayer between the support and the image forming layer, or an interlayer between the image forming layer and the sublayer. The foregoing layers each may be a single layer or at least two layers which are the same or different in composition.

The photothermographic material according to this invention contains the above-described secondary or tertiary amino group-containing alkoxysilane compound in combination with the above-described polyethyleneimine, thereby minimizing fogging and variation in contrast, caused in storage of the pre-exposed photothermographic material.

In this invention, the secondary or tertiary amino group-containing alkoxysilane compound and the polyethyleneimine each may be contained in any of the image forming layer, protective layer, backing layer and backing protective layer. The secondary or tertiary amino group-containing alkoxysilane compound and the polyethyleneimine may be contained in the same layer or in different layers. The alkoxysilane compound is contained preferably in the image forming layer or the protective layer, and the polyethyleneimine is contained preferably in the backing layer or the backing protective layer.

An amount of the alkoxysilane compound to be contained in the image forming layer or protective layer is preferably 100 to 1000 mg/m$^2$, and more preferably 300 to 950 mg/m$^2$. In the case of a content of less than 100 mg/m$^2$, some alkoxysilane compounds result in no effect and a content of more than 1000 mg/m$^2$ often results excessive effects on contrast stabilization, leading to deteriorated contrast. The alkoxysilane compound may be contained in the backing layer or backing protective layer, in the same amount as above, together with the polyethyleneimine.

An amount of the polyethyleneimine to be contained in the backing layer or the backing protective layer is preferably 1 to 100 mg/m$^2$, and more preferably 5 to 50 mg/m$^2$. A content of less than 1 mg/m$^2$ exhibits no anti-fogging effect and a content of more than 100 mg/m$^2$ results in excessively anti-fogging effect, leading to deteriorated contrast. The polyethyleneimine may be contained in the image forming layer or protective layer, in the same amount as above, together with the alkoxysilane compound.

Specific examples of the secondary or tertiary amino group-containing alkoxysilane compound are shown below but are not limited to these.

S-1

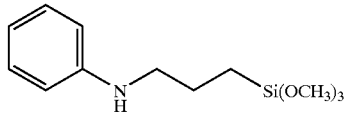

S-2

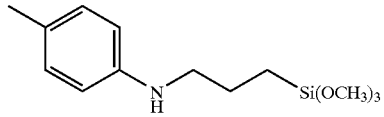

S-3

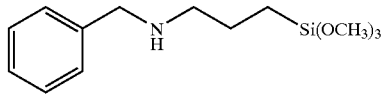

S-4

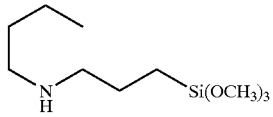

S-5

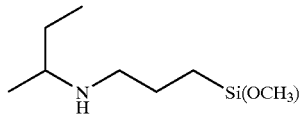

S-6

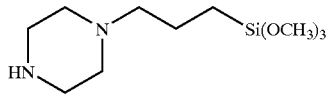

S-7

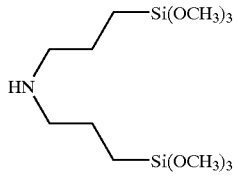

S-8

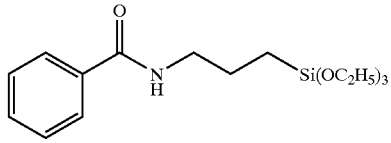

S-9

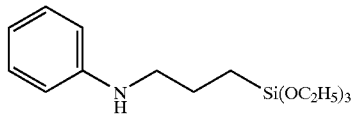

-continued

S-10

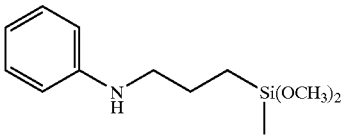

S-11

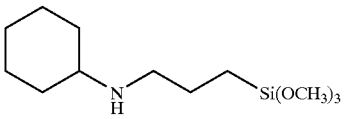

S-12

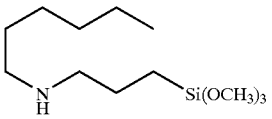

S-13

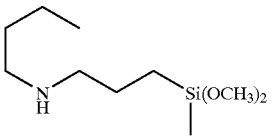

S-14

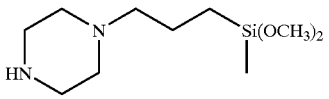

S-15

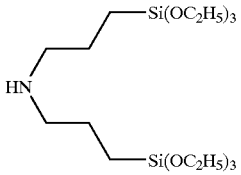

S-16

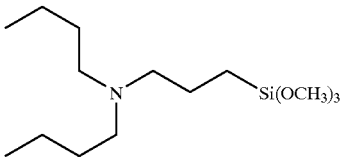

S-17

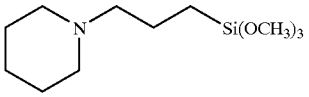

S-18

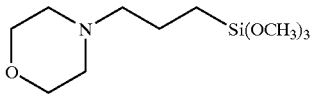

S-19

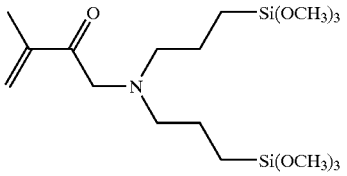

S-20

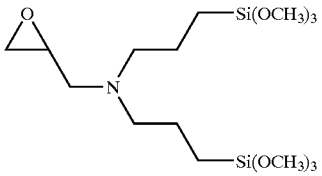

-continued

S-21

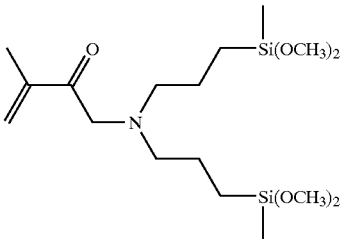

S-22

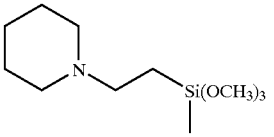

S-23

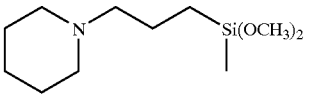

S-24

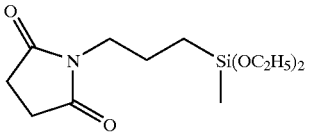

S-25

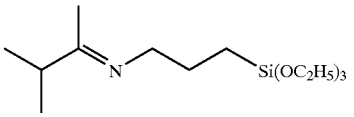

Of the above-described secondary or tertiary amino group-containing alkoxysilane compound, the use of the compound represented by the foregoing formula (1a) and (1b) in combination with the polyethyleneimine is specifically preferred in terms of inhibiting a density increase in unexposed areas and minimizing contrast variation caused in the pre-exposure storage of the photothermographic material.

In the formulas (1a) and (1b), examples of a straight chain or branched bivalent saturated hydrocarbon group having 1 to 10 carbon atoms, represented by X and Y include methylene, dimethylene, propylene, pentamethylene and decamethylene, which may be substituted. Examples of a straight chain or branched saturated hydrocarbon group having 1 to 4 carbon atoms, represented by $R_1$, $R_2$, $R_5$ and $R_6$ include methyl, ethyl, propyl, butyl and tert-butyl, which may be substituted. Examples of an aliphatic group having 1 to 20 carbon atoms, represented by $R_3$ and $R_4$ include methyl, ethyl, propyl, butyl, tert-butyl, octyl, decyl and cyclohexyl. Examples of an aromatic group represented by $R_3$ and $R_4$ include a phenyl group and a naphthyl group. Examples of a ring formed by $R_3$ and $R_4$ include pyrrolidine, pyrroline, imidazolidine, imidazoline, pyrazoline, piperidine, piperazine and morpholine.

Polyethyleneimines having any structure are usable in this invention. Polyethylenes can be described in the following general formula:

$$-(CH_2-CH_2-NH)_n- \quad (n=10-10^5).$$

The molecular weight (Mn, number-average molecular weight) of the polyethyleneimines is preferably 200 to 40,000, and more preferably 300 to 5,000. Polyethyleneimines of less than 200 (Mn) are thermally liable to diffuse, resulting in reduced effects of the invention; and ones of more than 40,000 result in markedly increased viscosity, often leading to deteriorated handleability and lowered productivity.

The foregoing homopolymeric polyethyleneimines usable in this invention include linear polyethyleneimines and branched polyethyleneimines with a well defined ratio of primary, secondary and tertiary amine functions. Such branched polyethyleneimines are represented, for example, in the following partial structural formula:

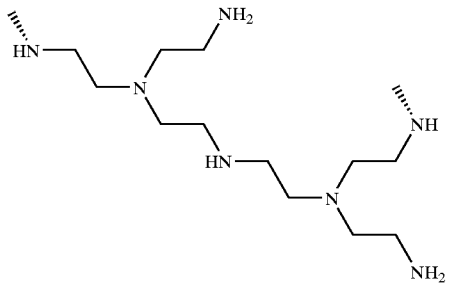

The ratio of primary, secondary and tertiary amine functions is preferably 20 to 50%. A proportion of less than 20% lowers an antifogging effect and sufficient anti-fogging is not achieved. A proportion of more than 50% leads to similar results. Examples of commercially available branched polyethyleneimines include EPOMIN SP-006, EPOMIN SP-012, EPOMIN SP-103, available from Nippon Shokubai Co., Ltd; Lupasol FG and Lupasol WF, available from BASF.

The foregoing polyethyleneimines may be used alone or in combination thereof, which can be incorporated singly or through solution in organic solvents such as alcohols or metyl ethyl ketone.

Organic silver salts, as a reducible silver source are contained in the image forming layer reducible silver source, and silver salts of organic acids or organic heteroacids are preferred and silver salts of long chain fatty acid (preferably having 10 to 30 carbon atom and more preferably 15 to 25 carbon atoms) or nitrogen containing heterocyclic compounds are more preferred. Specifically, organic or inorganic complexes, ligands of which have a total stability constant to a silver ion of 4.0 to 10.0 are preferred. Exemplary preferred complex salts are described in RD17029 and RD29963, including organic acid salts (e.g., salts of gallic acid, oxalic acid, behenic acid, stearic acid, palmitic acid, lauric acid, etc.); carboxyalkylthiourea salts (e.g., 1-(3-carboxypropyl)thiourea, 1-(3-caroxypropyl)-3,3-dimethylthiourea, etc.); silver complexes of polymer reaction products of aldehyde with hydroxy-substituted aromatic carboxylic acid (e.g., aldehydes such as formaldehyde, acetaldehyde, butylaldehyde), hydroxy-substituted acids (e.g., salicylic acid, benzoic acid, 3,5-dihydroxybenzoic acid, 5,5-thiodisalicylic acid, silver salts or complexes of thiones (e.g., 3-(2-carboxyethyl)-4-hydroxymethyl-4-(thiazoline-2-thione and 3-carboxymethyl-4-thiazoline-2-thione), complexes of silver with nitrogen acid selected from imidazole, pyrazole, urazole, 1,2,4-thiazole, and 1H-tetrazole, 3-amino-5-benzylthio-1,2,4-triazole and benztriazole or salts thereof; silver salts of saccharin, 5-chlorosalicylaldoxime, etc.; and silver salts of mercaptides. Of these organic silver salts, silver salts of fatty acids are preferred, and silver salts of behenic acid, arachidic acid and/or stearic acid are specifically preferred. A mixture of two or more kinds of organic silver salts is preferably used, enhancing developability and forming silver images exhibiting relatively high density and high contrast. For example, preparation by adding a silver ion solution to a mixture of two or more kinds of organic acids is preferable.

The organic silver salt compound can be obtained by mixing an aqueous-soluble silver compound with a compound capable of forming a complex. Normal precipitation, reverse precipitation, double jet precipitation and controlled double jet precipitation, as described in JP-A 9-127643 are preferably employed. For example, to an organic acid can be added an alkali metal hydroxide (e.g., sodium hydroxide, potassium hydroxide, etc.) to form an alkali metal salt soap of the organic acid (e.g., sodium behenate, sodium arachidate, etc.), thereafter, the soap and silver nitrate are mixed by the controlled double jet method to form organic silver salt crystals. In this case, silver halide grains may be concurrently present.

Organic silver salt grains preferably have an average grain size of 1 $\mu$m or less and are monodisperse. The average grain size of the organic silver salt as described herein is, when the grain of the organic salt is, for example, a spherical, cylindrical, or tabular grain, a diameter of the sphere having the same volume as each of these grains. The average grain size is preferably between 0.01 and 0.8 $\mu$m, more preferably between 0.05 and 0.5 $\mu$m. Furthermore, the monodisperse as described herein is the same as silver halide grains and preferred monodispersibility is between 1 and 30%. It is also preferred that at least 60% of the total of the organic silver salt is accounted for by tabular grains. The tabular grains refer to grains having a ratio of an average grain diameter to grain thickness, i.e., aspect ratio (denoted as AR) of 3 or more:

$$AR = \text{average diameter } (\mu m)/\text{thickness } (\mu m)$$

After tabular organic silver salt grains used in this invention are preliminarily dispersed together with binders, surface active agents, etc., if desired, the resulting mixture is preferably dispersed and pulverized by a media homogenizer, a high pressure homogenizer, or the like. During said preliminary dispersion, ordinary stirrers such as an anchor type, a propeller type, etc., a high-speed rotation centrifugal radial type stirrer (Dissolver), as a high speed shearing stirrer (homomixer) may be employed.

Furthermore, as the media homogenizers may be used rolling mills such as a ball mill, a satellite ball mill, a vibrating ball mill, medium agitation mills such as a bead mill, atriter, and others such as a basket mill. As high pressure homogenizers may be employed various types such as a type in which collision occurs against a wall or a plug, a type in which liquid is divided into a plurality of portions and said portions are subjected to collision with each other, a type in which liquid is forced to pass through a narrow orifice, etc.

In devices employed for dispersing the tabular organic silver salt grains used in this invention, preferably employed as the members which are in contact with the organic silver salt grains are ceramics such as zirconia, alumina, silicone nitride, boron nitride, or diamond. Of these, zirconia is the one most preferably employed. The content of the zirconia in a light sensitive emulsion containing light sensitive silver halide and an organic silver salt is preferably 0.01 to 0.5 mg, and more preferably 0.01 to 0.3 mg per g of silver. When the dispersion procedure described above is conducted, optimization of a binder concentration, preliminary dispersing process, operation conditions of a dispersing machine and dispersion frequency are specifically preferred to obtain organic silver salt grains used in this invention.

Silver halide grains contained in the image forming layer function as a photosensor. In order to minimize cloudiness after image formation and to obtain excellent image quality, the less the average grain size, the more preferred, and the average grain size is preferably not more than 0.03 μm, and more preferably between 0.01 and 0.03 μm.

Silver halide grains used in the photothermographic material according to this invention can be preferably prepared simultaneously with preparation of organic silver salts described above or by allowing silver halide grains to be concurrently present with organic silver salt to form silver halide grains fused onto the organic silver salt, so-called in situ fine silver halide grains. The average grain size of silver halide grains can be determined in such a manner that silver halide grains are photographed using an electron microscope at 50,000 magnifications, from which major and minor edge lengths of the grain are measured and an average value for 100 grains is defined as an average grain size. The average grain size as described herein is defined as an average edge length of silver halide grains, in cases where they are so-called regular crystals in the form of cube or octahedron. Furthermore, in cases where grains are not regular crystals, for example, spherical, bar-like grains or tabular grains, the grain size refers to the diameter of a sphere having the same volume as the silver grain. Furthermore, silver halide grains are preferably monodisperse grains. The monodisperse grains as described herein refer to grains having a degree of monodispersity obtained by the formula described below of not more than 40%; more preferably not more than 30%, still more preferably 0.1 to 20%.

Degree of monodispersity=(standard deviation of grain diameter)/(average grain diameter)×100 (%)

Silver halide rains used in this invention preferably have an average grain size of 0.01 to 0.03 μm and are preferably monodisperse, thereby leading to enhance image quality. The shape of silver halide grains is not specifically limited but a high ratio accounted for by a Miller index [100] plane is preferred. This ratio is preferably at least 50%; is more preferably at least 70%, and is most preferably at least 80%. The ratio accounted for by the Miller index [100] face can be obtained based on T. Tani, J. Imaging Sci., 29, 165 (1985) in which adsorption dependency of a [111] face or a [100] face is utilized.

One more preferred shape of silver halide grains is a tabular grain. The tabular grain is referred to as one having an aspect ratio (r/h) of 3 or more, in which r is a grain diameter (μm), represented by a square root of a grain projected area and h is a grain thickness (μm) in the vertical direction. Tabular grains having an aspect ratio of 3 to 50 are specifically preferred. The grain diameter is preferably 0.03 or less, and more preferably 0.01 to 0.03 μm. The tabular grains can readily be prepared according to methods described in U.S. Pat. Nos. 5,264,337, 5,314,798 and 5,320,958. In this invention, the use of tabular grains results in further enhanced sharpness.

Halide composition of the silver halide used in this invention is not specifically limited, including silver chloride, silver chlorobromide, silver bromide, silver iodobromide, silver iodochlorobromide.

The silver halide grains used in this invention can be prepared according to the methods described in P. Glafkides, Chimie Physique Photographique (published by Paul Montel Corp., 19679; G. F. Duffin, Photographic Emulsion Chemistry (published by Focal Press, 1966); V. L. Zelikman et al., Making and Coating of Photographic Emulsion (published by Focal Press, 1964).

Silver halide used in this invention preferably occludes ions of metals belonging to Groups 6 to 11 of the Periodic Table or complex ions thereof to improve intensity reciprocity failure or adjust contrast. Preferred as the metals are W; Fe, Co, Ni, Cu, Ru, Rh, Pd, Re, Os, Ir, Pt and Au.

Silver halide grain emulsions may be subjected to washing to remove soluble salts, employing commonly known methods such as noodle washing method and flocculation method.

Silver halide grains are preferably chemically sensitized. Examples of preferred chemical sensitization usable in this invention include sulfur sensitization, selenium sensitization, tellurium sensitization, noble metal sensitization using gold compounds and platinum, palladium or iridium compounds, and reduction sensitization.

To prevent haze of the photothermographic material, the total amount of silver halide grains and an organic silver salt is preferably 0.3 to 3.2 g/m$^2$, and more preferably 0.5 to 1.5 g/m$^2$ in terms of silver coverage, whereby high contrast images can be obtained. The ratio of silver halide to total silver is preferably not more than 50%, more preferably not more than 25%, and still more preferably 0.1 to 15% by weight.

Silver halide grains relating to this invention, which have an absorption maximum within the wavelength region of 350 to 450 μm, may optionally be contained with sensitizing dyes.

Reducing agents are incorporated into the photothermographic material of this invention. Examples of suitable reducing agents are described in U.S. Pat. Nos. 3,770,448, 3,773,512, and 3,593,863, and Research Disclosure Items 17029 and 29963, and examples thereof include the following: aminohydroxycycloalkenone compounds (for example, 2-hydroxypiperidino-2-cyclohexane); esters of amino reductones as the precursor of reducing agents (for example, piperidinohexose reducton monoacetate); N-hydroxyurea derivatives (for example, N-p-methylphenyl-N-hydroxyurea); hydrazones of aldehydes or ketones (for example, anthracenealdehyde phenylhydrazone; phosphamidophenols; phosphamidoanilines; polyhydroxybenzenes (for example, hydroquinone, t-butylhydroquinone, isopropylhydroquinone, and (2,5-dihydroxy-phenyl) methylsulfone); sulfydroxamic acids (for example, benzenesulfhydroxamic acid); sulfonamidoanilines (for example, 4-(N-methanesulfonamide)aniline); 2-tetrazolylthiohydroquinones (for example, 2-methyl-5-(1-phenyl-5-tetrazolylthio)hydroquinone); tetrahydroquinoxalines (for example, 1,2,3,4-tetrahydroquinoxaline); amidoxines; azines (for example, combinations of aliphatic carboxylic acid arylhydrazides with ascorbic acid); combinations of polyhydroxybenzenes and hydroxylamines, reductones and/or hydrazine; hydroxamic acids; combinations of azines with sulfonamidophenols; α-cyanophenylacetic acid derivatives; combinations of bis-β-naphthol with 1,3-dihydroxybenzene derivatives; 5-pyrazolones, sulfonamidophenol reducing agents, 2-phenylindane-1,3-dione, etc.; chroman; 1,4-dihydropyridines (for example, 2,6-dimethoxy-3,5-dicarboethoxy-1,4-dihydropyridine); bisphenols (for example, bis(2-hydroxy-3-t-butyl-5-methylphenyl)methane, bis(6-hydroxy-m-tri)mesitol, 2,2-bis(4-hydroxy-3-methylphenyl)propane, 4,5-ethylidene-bis(2-t-butyl-6-methyl)phenol, UV-sensitive ascorbic acid derivatives and 3-pyrazolidones. Of these, particularly preferred reducing agents are hindered phenols.

As hindered phenols, listed are compounds represented by the general formula (A) described below:

formula (A)

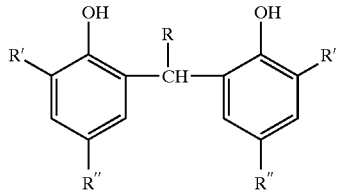

wherein R represents a hydrogen atom or an alkyl group having from 1 to 10 carbon atoms (e.g., —$C_4H_9$, 2,4,4-trimethylpentyl), and R' and R" each represents an alkyl group having from 1 to 5 carbon atoms (e.g., methyl, ethyl, t-butyl).

Exemplary examples of the compounds represented by the formula (A) are shown below.

A-1

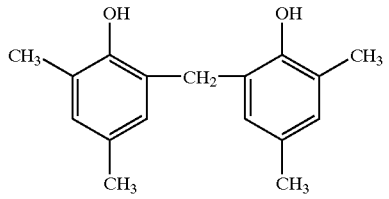

A-2

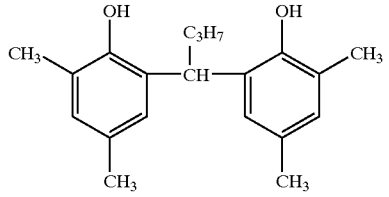

A-3

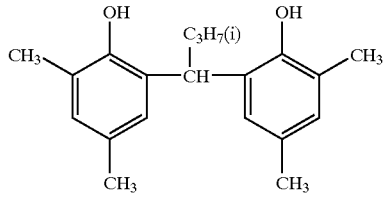

A-4

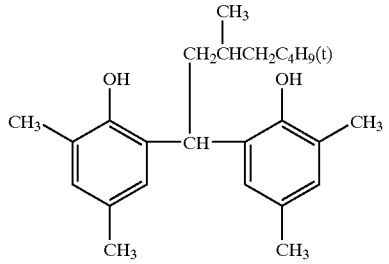

A-5

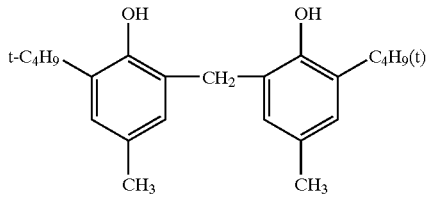

-continued

A-6

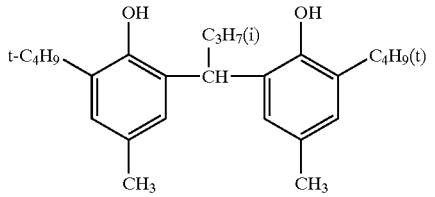

A-7

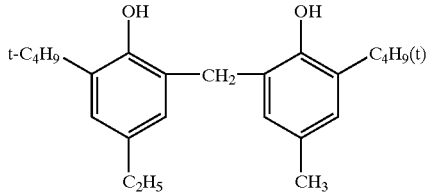

The used amount of reducing agents represented by the above-mentioned general formula (A) is preferably $1\times10^{-2}$ to 10 moles, and is more preferably $1\times10^{-2}$ and 1.5 moles per mole of silver.

In one preferred embodiment of this invention, the image forming layer or the protective layer provided on the image forming layer contains hydrazine compounds as a contrast-increasing agent. Examples of hydrazine compounds include those described in Research Disclosure Item 23515 (November 1983, page 346); U.S. Pat. Nos. 4,080,207, 4,269,929, 4,276,364, 4,278,748, 4,385,108, 4,459,347, 4,478,928, 4,560,638, 4,686,167, 4,912,016, 4,988,604, 4,994,365, 5,041,355, 5,104,769; British Patent No. 2,011, 391B; European Patent No. 217,310, 301,799, 356,898; JP-A No. 60-170734, 61-170733, 61-270744, 62-178246, 62-270948, 63-29751, 63-32538, 63-104047, 63-121838, 63-129337, 63-223744, 63-234244, 63-234245, 63-234246, 63-294552, 63-306438, 64-10238, 1-90439, 1-100530, 1-105941, 1-105943, 1-276128, 1-280747, 1-283548, 1-283549, 1-285940, 2-2541, 2-77057, 2-139538, 2-196234, 2-196235, 2-198440, 2-198441, 2-198442, 2-220042, 2-221953, 2-221954, 2-285342, 2-285343, 2-289843, 2-302750, 2-304550, 3-37642, 3-54549, 3-125134, 3-184039, 3-240036, 3-240037, 3-259240, 3-280038, 3-285336, 4-51143, 4-56842, 4-84134, 2-230233, 4-96053, 4-16544, 5-45761, 5-45762, 5-45763, 5-45764, 5-45765, 6-289524, and 9-160164.

Further, there are also usable compounds described in JP-B No. 6-77138 (hereinafter, the term, JP-B refers to Japanese Patent Publication), specifically, compound described in page 3–4; compounds represented by general formula (1) described in JP-B No. 6-98082, specifically, compounds 1 through 38 described on page 8–18; compounds represented by general formulas (4), (5) and (6) described in JP-A No. 6-23049, specifically, compounds 4-1 through 4-10 on page 25–26, compounds 5-1 through 5-42 on page 39–40 and compound 6-1 through 6-6 on page 40; compounds represented by general formula (1) or (2) described in Jp-A No. 6-289520, specifically compounds 1-1) through 1-17) and 2-1) on page 5–7; compounds described in JP-A 6-313936, page 6–19; compounds described in JP-A 6-313951, specifically, compounds on page 3–5; compounds represented by general formula (I) described in JP-A No. 7-5610, specifically, compounds I-1 through I-38 on page 5–10; compounds represented by general formula (II) described in JP-A No. 7-77783, specifically, compounds II-1 through II-102 on page 10–27; and compounds represented by general formula (H)or (Ha) described in JP-A No. 7-104426, specifically, compounds H-1 through H-44 on page 8–15.

Other contrast-increasing agents usable in this invention include compounds described in JP-A No. 11-316437, page 33–53. Furthermore, the following compounds described in JP-A No. 12-298327, page 21–24 are preferred, as shown below.
C-1
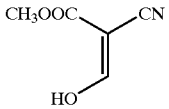
C-2
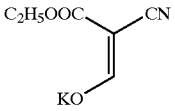
C-3
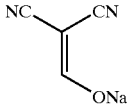
C-4
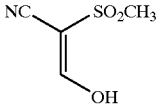
C-5
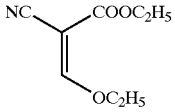
C-6
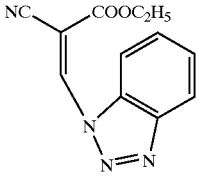
C-7
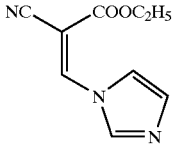
C-8
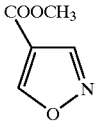
C-9
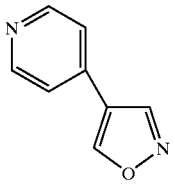
C-10
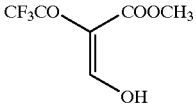
C-11
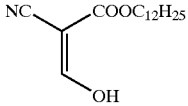
C-12
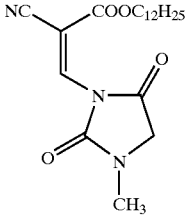
C-13
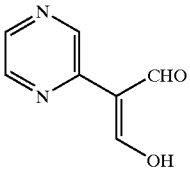
C-14
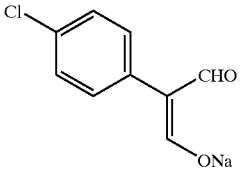
C-15
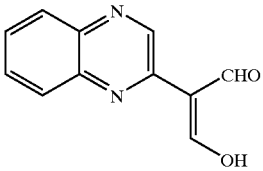
C-16
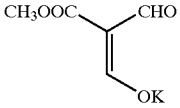
C-17
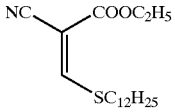
C-18
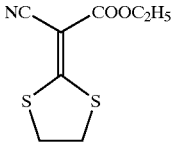

-continued
C-19
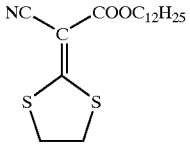
C-20
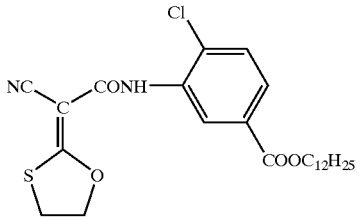
C-21
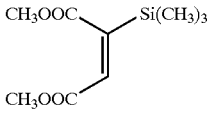
C-22
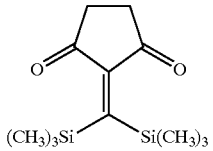
C-23
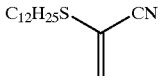
C-24
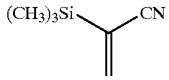
C-25
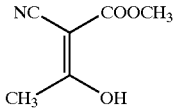
C-26
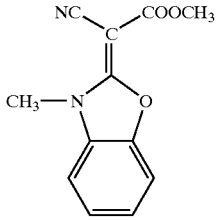
C-27
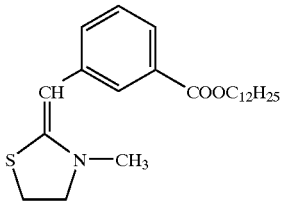
C-28
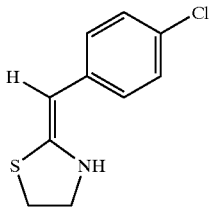
C-29
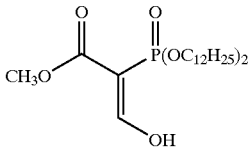
C-30
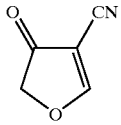
C-31
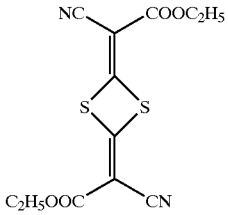
C-32
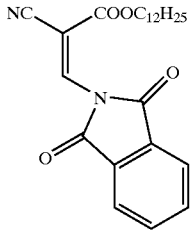
C-33
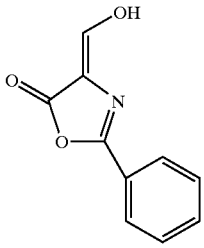
C-34
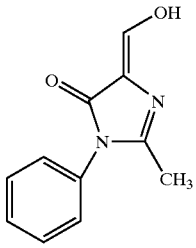

-continued
C-35
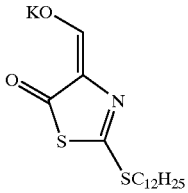
C-36
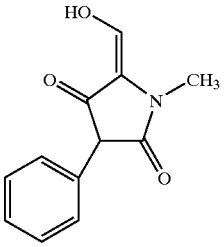
C-37
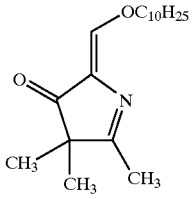
C-38
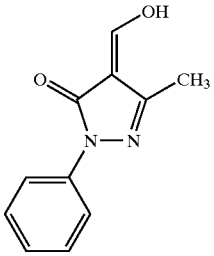
C-39
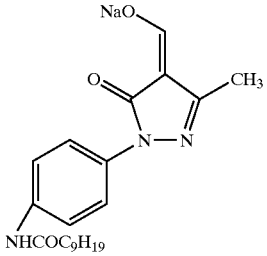
C-40
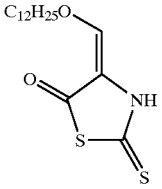
C-41
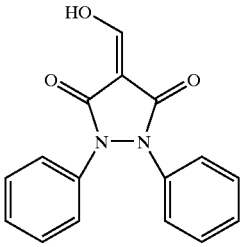
C-42
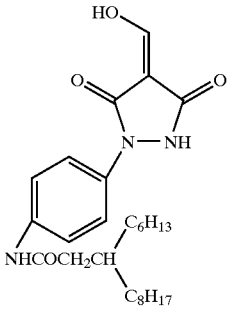
C-43
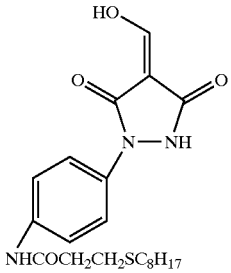
C-44
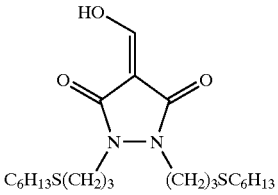

-continued
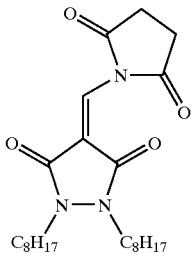
C-45
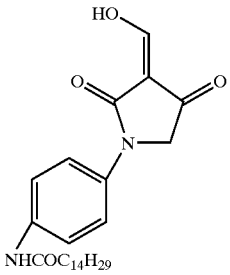
C-46
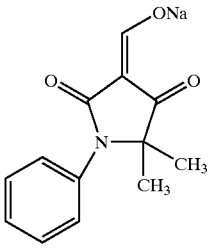
C-47
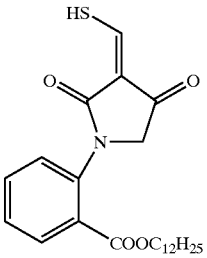
C-48
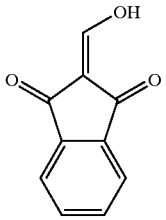
C-49
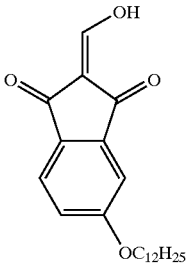
C-50
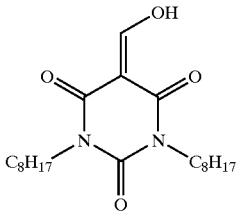
C-51
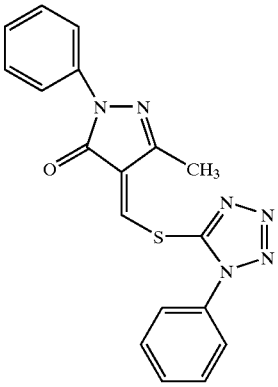
C-52
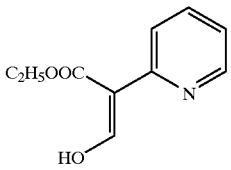
C-53
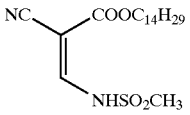
C-54

-continued
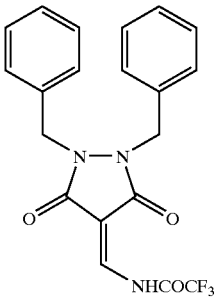
C-55
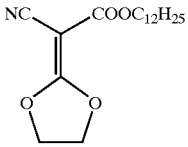
C-56
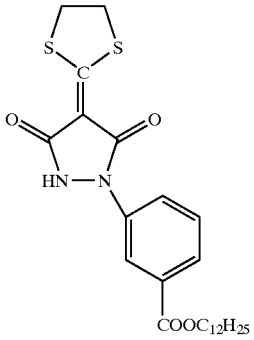
C-57
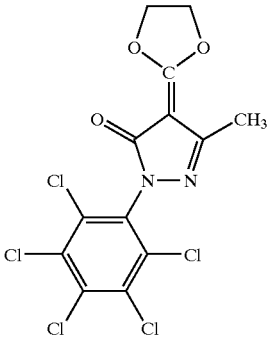
C-58
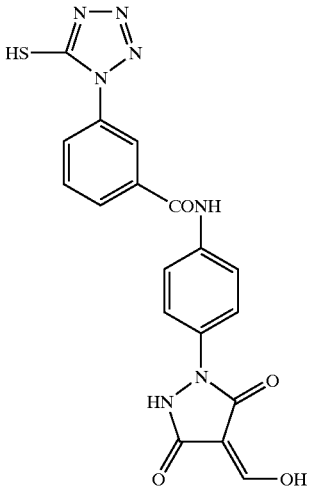
C-59
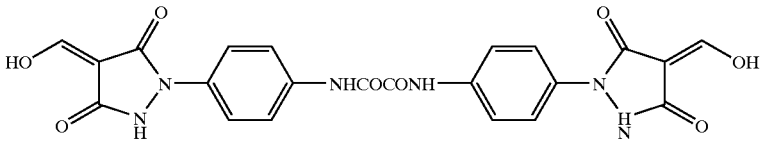
C-60
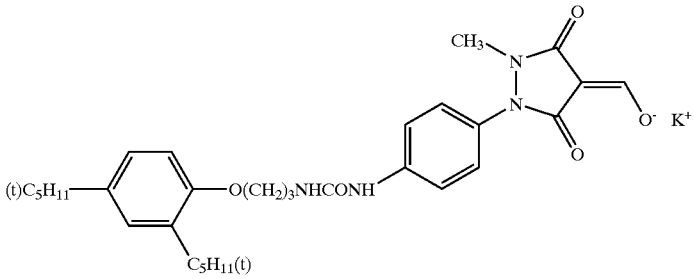
C-61

-continued

C-62

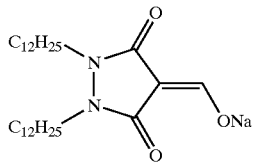

C-63

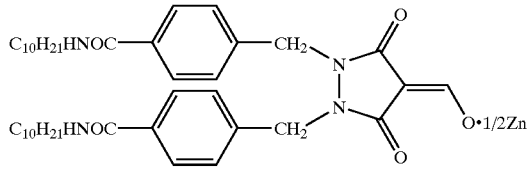

C-64

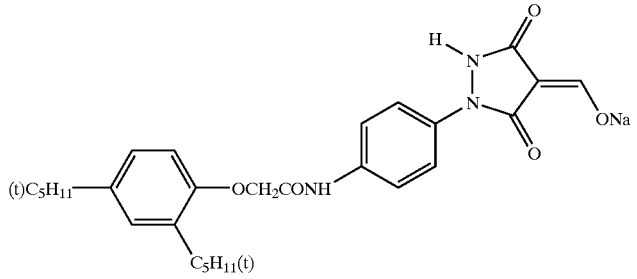

Binder resins are used in the image forming layer to hold an organic silver salt, light-sensitive silver halide, reducing agent and the like. The binder resin is transparent or translucent and, in general, colorless, including natural polymers, synthetic polymers and copolymers. Specific examples thereof include gelatin, gum Arabic, poly(vinyl alcohol), hydroxyethylcellulose, cellulose acetate, cellulose acetate-butyrate, poly(vinyl pyrrolidone), casein, starch, poly (acryric acid), copoly(styrene-anhydrous maleic acid), copoly(styrene-acrylontrile), copoly(styrene-butadiene), poly(vinyl acetal), such as poly(vinyl formal) and poly(vinyl butyral), polyesters, polyurethanes, phenoxy resin, poly (vinylidene chloride), polyepoxides, polycarbonates, poly (vinyl acetate), cellulose esters and polyamides. Binders used in the photothermographic materials of this invention may be a hydrophilic binder or hydrophobic one. The use of hydrophobic transparent binders are preferred to reduce fogging after thermal development. Of the foregoing binders, polyvinyl butyral, cellulose acetate, cellulose acetate butyrate, polyester, polycarbonate, poly(acrylic acid) and polyurethane are preferred; and polyvinyl butyral, cellulose acetate, cellulose acetate butyrate and polyester are specifically preferred. As described above, the use of hydrophobic transparent binders is preferred, in which a water-soluble resin or a water-dispersible resin (latex) may be used in combination.

Organic solvents are mainly used to dissolve or disperse the foregoing hydrophobic transparent and preferred examples thereof include alcohols (e.g., methanol, ethanol, propanol), ketones (e.g., acetone, methyl ethyl ketone), dimethylformamide, dimethylsulfoxide and methyl cellosolve. Water may optionally be contained therein, in amount of 20% by weight or less, preferably 10% by weight or less, and more preferably 5% by weight or less.

The content of a binder resin in the image forming layer is preferably 1.5 to 10 g/m$^2$, and more preferably 1.7 to 8 g/m$^2$ to enhance a thermal-developing rate. A content of less than 1.5 g/m$^2$ of some resins often results in an increased density in unexposed areas to a level unacceptable in practice. A content of more than 10 g/m$^2$ of some resins results in lowering in developability leading to an insufficient density.

Binder resins can be used in a protective layer provided on the image forming layer to protect the image forming layer, in a backing layer or a backing protective layer provided on the opposite side to the image forming layer to maintain transportability or prevent blocking with the protective layer. A binder resin used in a non-image forming layer such as a protective layer, a backing layer or a backing protective layer may be the same as or different from one used in the image forming layer. Further, a binder resin such as an epoxy resin or acryl monomer, which is hardenable on exposure to actinic rays, may be used in the non-image forming layer.

The image forming layer or protective layer relating to this invention preferably contains a matting agent to prevent slipping or fingerprint smudge of the photothermographic material. The content of a matting agent is preferably 0.5 to 30% by weight, based on total binder. A matting agent is also preferably contained in at least one of non-image forming layers provided on the opposite side of the support to the image forming layer, such as a backing layer and a backing protective layer, in an amount of 0.5 to 40% by weight, based on the total binder contained in the backing layer and backing protective layer. Any matting agent, irrespective of a regular form or being amorphous, is usable in this invention, so long as physical properties described below are satisfied. Specific examples thereof include amorphous silica, boron nitride, aluminum nitride, titanium dioxide, titanium dioxide, magnesium oxide, aluminum oxide, calcium oxide, hydroxyapatite, magnesium carbonate, barium sulfate, strontium sulfate, polymethyl methacrylate, polymethyl acrylate, polystyrene, polyacrylonitrile, cellulose acetate, cellulose propionate, silicone, and Teflon(R). There are also usable fine particles which have been impregnated with a wax or silicone oil to give a slipping property or which have been surface-modified with a silane coupling agent or titanium coupling agent. A particle size of matting agents is usually represented by a sphere equivalent diameter. In this invention, a particle size of a matting agent is also expressed in a sphere equivalent diameter. The average particle size of a matting agent used in the image forming layer is preferably 0.5 to 10 $\mu$m, and more preferably 1.0 to 8 $\mu$m. The average particle size of a matting agent used in the backing layer or backing protective layer is preferably 3.0 to 20 $\mu$m, and more preferably 4.0 to 15 $\mu$m.

The image forming layer relating to the invention may optionally contain, in addition to the foregoing essential constituents, commonly known additives, such as an antifoggant, image toning agent, sensitizing dye, material exhibiting supersensitization (hereinafter, also denoted as supersensitizer) and a silver-saving agent. Examples of the antifoggant include compounds disclosed in JP-B No. 54-44212 and 51-9694, JP-A No. 55-140833 and U.S. Pat. Nos. 3,874,946 and 4,756,999; substituent-containing heterocyclic compound represented by formula of —$C(X_1)(X_2)(X_3)$, in which $X_1$ and $X_2$ represent a halogen atom and $X_3$ represents a hydrogen atom or halogen atom; and compounds disclosed in JP-A 9-288328 and 9-90550, U.S. Pat. No. 5,028,523, European Patent No. 600,587, 605,981 and 631,176. Furthermore, compounds described below may be used alone or in combination.

Image toning agents may be used to modify silver image tone. Examples thereof include imides (for example, phthalimide), cyclic imides, pyrazoline-5-one, and quinazolinone (for example, succinimide, 3-phenyl-2-pyrazoline-5-on, 1-phenylurazole, quinazoline and 2,4-thiazolidione); naphthalimides (for example, N-hydroxy-1,8-naphthalimide); cobalt complexes (for example, cobalt hexaminetrifluoroacetate), mercaptans (for example, 3-mercapto-1,2,4-triazole); N-(aminomethyl) aryldicarboxyimides (for example, N-(dimethylaminomethyl)phthalimide); blocked pyrazoles, isothiuronium derivatives and combinations of certain types of light-bleaching agents (for example, combination of N,N'-hexamethylene(1-carbamoyl-3,5-dimethylpyrazole), 1,8-(3,6-dioxaoctane)bis(isothiuroniumtrifluoroacetate), and 2-(tribromomethylsulfonyl)benzothiazole; merocyanine dyes (for example, 3-ethyl-5-((3-etyl-2-benzothiazolinylidene(benzothiazolinylidene))-1-methylethylidene-2-thio-2,4-oxazolidinedione); phthalazinone, phthalazinone derivatives or metal salts thereof (for example, 4-(1-naphthyl)phthalazinone, 6-chlorophthalazinone, 5,7-dimethylphthalazinone, and 2,3-dihydro-1,4-phthalazinedione); combinations of phthalazinone and sulfinic acid derivatives (for example, 6-chlorophthalazinone and benzenesulfinic acid sodium, or 8-methylphthalazinone and p-trisulfonic acid sodium); combinations of phthalazine and phthalic acid; combinations of phthalazine (including phthalazine addition products) with at least one compound selected from maleic acid anhydride, and phthalic acid, 2,3-naphthalenedicarboxylic acid or o-phenylenic acid derivatives and anhydrides thereof (for example, phthalic acid, 4-methylphthalic acid, 4-nitrophthalic acid, and tetrachlorophthalic acid anhydride); quinazolinediones, benzoxazine, naphthoxazine derivatives, benzoxazine-2,4-diones (for example, 1,3-benzoxazine-2,4-dione); pyrimidines and asymmetry-triazines (for example, 2,4-dihydroxypyrimidine), and tetraazapentalene derivatives (for example, 3,6-dimercapto-1,4-diphenyl-1H,4H-2,3a,5,6a-tatraazapentalene). Preferred tone modifiers include phthalazone or phthalazine. The image toning agent may be incorporated into a protective layer, without adversely affecting the object of the invention.

As a sensitizing dye is used simple merocyanines described in JP-A No. 60-162247 and 2-48635, U.S. Pat. No. 2,161,331, West German Patent No. 936,071, and Japanese Patent Application No. 3-189532, used for an argon ion laser light source; trinuclear cyanines described in JP-A No. 50-62425, 54-18726 and 59-102229 and merocyanines described in Japanese Patent Application No. 6-103272, used for a helium neon laser light source; thiacarbocyanines described in JP=B No. 48-42172, 51-9609 and 55-39818, JP-A No. 62-284343 and 2-105135, used for LED and infrared semiconductor laser light source; tricarbocyanines described in JP-A 59-191032 and 60-80841 and dicarbocyanines having 4-quinoline nuclear described in JP-A No. 59-192242 and in general formulas (IIIa) and (IIIb) of JP-A No. 3-67242, used for infrared semiconductor laser light source. In response to the case where the wavelength of an infrared laser light source is 750 nm or more, and preferably 800 nm or more are preferably used sensitizing dyes described in JP-A No. 4-182639 and 5-341432, JP-B No. 6-52387 and 3-10931, U.S. Pat. No. 5,441,866, and JP-A No. 7-13295.

Useful sensitizing dyes, dye combinations exhibiting super-sensitization and materials exhibiting supersensitization are described in RD17643 (published in December, 1978), IV-J at page 23, JP-B 9-25500 and 43-4933 (herein, the term, JP-B means published Japanese Patent) and JP-A 59-19032, 59-192242 and 5-341432. In the invention, an aromatic heterocyclic mercapto compound represented by the following formula (M) and disulfide compound which is capable of forming the mercapto compound are preferred as a supersensitizer:

Ar—SM formula (M)

Ar—S—S—Ar Formula (Ma)

wherein M is a hydrogen atom or an alkali metal atom; Ar is an aromatic heterocyclic ring or condensed aromatic heterocyclic ring containing a nitrogen atom, oxygen atom, sulfur atom, selenium atom or tellurium atom. Examples of preferred aromatic heterocyclic ring include benzimidazole, naphthoimidazole, benzothiazole, naphthothiazole, benzoxazole, naphthoxazole, benzotellurazole, imidazole, oxazole, pyrazolo, triazole, triazine, pyrimidine, pyridazine, pyrazine, pyridine, urine, quinoline and quinazolone. Ar in formula (Ma) is the same as defined in formula (M).

The aromatic heterocyclic rings described above may be substituted with a halogen atom (e.g., Cl, Br, I), a hydroxy group, an amino group, a carboxy group, an alkyl group (having one or more carbon atoms, and preferably 1 to 4 carbon atoms) or an alkoxy group (having one or more carbon atoms, and preferably 1 to 4 carbon atoms).

Organic sulfur compound shown below are also a preferred supersensitizer to achieve enhanced sensitivity.

(1)

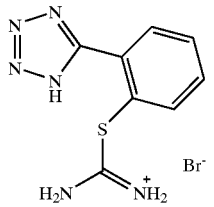

(2)

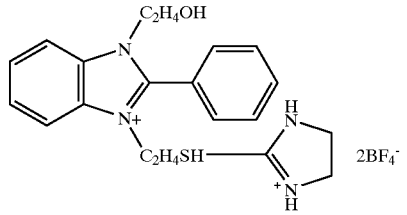

-continued (3)

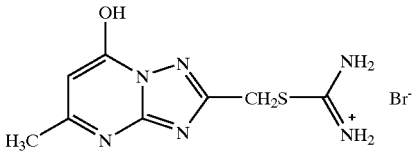

(4)

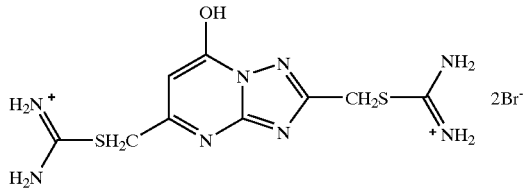

(5)

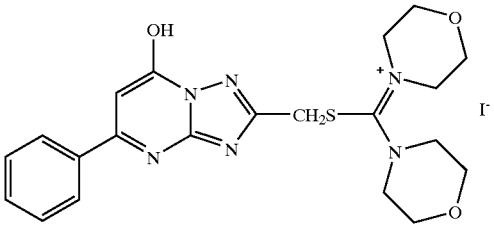

(6)

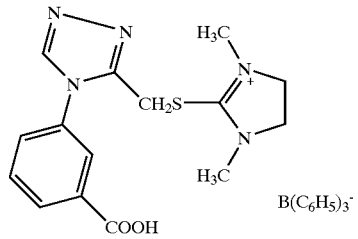

(7)

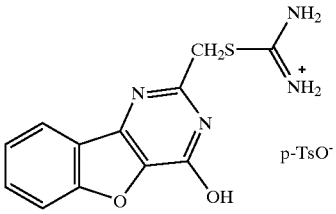

(8)

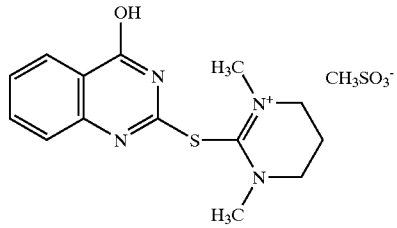

(9)

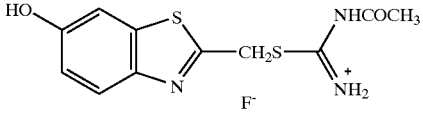

(10)

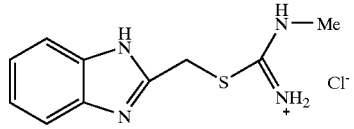

(11)

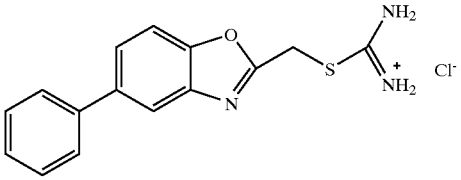

(12)

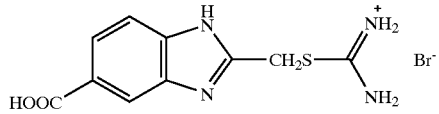

(13)

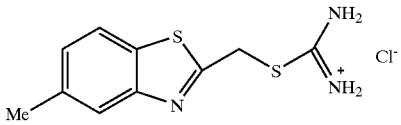

Supersensitizers relating to this invention are incorporated in the image forming layer containing an organic silver salt and silver halide grains, preferably in an amount of 0.001 to 1.0 mol, and more preferably 0.01 to 0.5 mol per mol of silver.

A macrocyclic compound containing a heteroatom may be incorporated in the image forming layer. Thus, macrocyclic compounds comprising a 9-membered or more membered ring (more preferably 12- to 24-membered ring, and still more preferably 15- to 21-membered ring), containing at least one heteroatom selected from nitrogen, oxygen, sulfur and selenium are preferable. Representative compounds thereof include so-called crown ether compounds, which were synthesized for the first time by Pederson in 1967, and many of which were synthesized since then. These compounds are detailed in C. J. Pederson, Journal of American Chemical Society, vol. 86 (2495), 7017–7036 (1967); G. W. Gokel, S. H. Korzeniowski "Maclocyclic Polyether Synthesis", Springer-Vergal, (1982).

In addition to the foregoing additives may be incorporated a surfactant, antioxidant, stabilizer, plasticizer, UV absorber and coating aid. These additives are optionally selected from compounds described in RD Item 17029 (June, 1978, page 9–15).

Supports used in the photothermographic material of this invention are preferably plastic films (for example, polyethylene terephthalate, polycarbonate, polyimide, nylon, cellulose triacetate, polyethylene naphthalate) to obtain a prescribed density and prevent deformation of images after being processed. Of these are more preferred plastic film of polyethylene terephthalate or polystyrene type polymer having a syndiotactic structure. The support thickness is usually 50 to 300 μm, and preferably 70 to 180 μm. There can also be used a thermally treated plastic support. Plastic support to be treated include those described above. The plastic support is thermally treated by heating at a temperature higher than a glass transition temperature of the support, by at least 30° C., preferably at least 35° C., and more preferably at least 40° C. However, heating at a temperature exceeding the melting point of the support unsuitably deteriorates a strength of the support.

There may be incorporated metal oxides and/or conductive compounds such as conductive polymer in component layers to improve electrostatic properties. These may be incorporated into any layer and preferably a sublayer, backing layer or an interlayer between the image forming layer and the sublayer.

The protective layer provided on the image forming layer is comprised of a binder used in the image forming layer and optional additives. As an additive to be incorporated into the protective layer, a filler is preferably incorporated to prevent flaws of images caused after thermal development or to maintain transportability. The filler is incorporated preferably in an amount of 0.05 to 30% by weight, based on the image forming layer. A lubricant or a antistatic may be incorporated in the protective layer to improve lubrication property and antistatic property. Examples of the lubricant include a fatty acid, fatty acid ester, fatty acid amide, polyoxyethylene, polyoxypropylene, (modified) silicone oil, (modified) silicone resin, (modified) fluorinated compound, (modified) fluorinated resin, fluorinated resin, fluoro-carbon, and wax. Examples of antistatic include a cationic surfactant, anionic surfactant, nonionic surfactant, polymeric antistatic agent, metal oxide and conductive polymer, compounds described in "11290 no Kagaku-shohin" (11290 Chemical Goods), published by Kagakukogyo-Nippo-Sha at page 875 to 876, and compounds described in U.S. Pat. No. 5,244,773, col. 14 to 20. The protective layer may be comprised of a single layer or plural layers which are the same or different in composition. The protective layer thickness is usually 1.0 to 5.0 $\mu$m. In addition to the image forming layer, support and protective layer, an interlayer may be provided to improve adhesion between the support and image forming layer. The interlayer is usually 0.05 to 2.0 $\mu$m thick.

The backing layer may be comprised of a single layer or plural layers which are the same or different in composition. The backing layer is preferably 0.1 to 10 $\mu$m thick.

To control the amount or wavelength distribution of light transmitting the image forming layer of the photothermographic material, there may be provided a filter dye layer on the image forming layer side or an antihalation dye layer on the opposite side, so-called backing layer. Alternatively, a dye or pigment may be incorporated into the image forming layer.

Slipping agents such as a polysiloxane compound, wax and liquid paraffin may be incorporated, together with the foregoing binder and matting agent, into the protective layer.

There are used various surfactants as a coating aid in component layers of the photothermographic material. Specifically, fluorine-containing surfactants are preferably used to improve antistatic characteristics or prevent dot-like coating troubles.

The image forming layer may be comprised of plural layers, which may be arranged in the order of a high-speed layer/low-speed layer, or a low-speed layer/high-speed layer to control contrast.

The photothermographic material of the invention can employ image toning agents described in Research Disclosure Item No. 17029. There may be incorporated mercapto compounds, disulfide compounds or thione compounds to control thermal development by retarding or accelerating thermal development, to enhance spectral sensitization efficiency or to enhance storage stability before or after development. Antifoggants may be used in the photothermographic material, which can be incorporated into any one of the image forming layer and non-image forming layer. There may be used surfactants, antioxidants, stabilizers, plasticizers and coating aids in the photothermographic material. As such additives and the foregoing additives are preferably employed compounds described in Research Disclosure Item No. 17029 (June, 1978, page 9–15).

Methods for incorporating the secondary or tertiary amino group-containing alkoxysilane compound and the polyethyleneimine into the image forming layer, the protective layer provided on the image forming layer, or the backing layer or backing protective layer are not specifically limited, a given amount of which may be directly added to a coating solution, or diluted with an optimal solvent and added to the coating solution.

In one preferred embodiment of the invention, constituents described above are respectively dissolved or dispersed in a solvent to prepare a coating solution to form the foregoing mage forming layer and protective layer, and an interlayer optionally provided. Solvents having a solubility parameter of 6.0 to 15.0, which is described in "YOZAI POCKET BOOK" (Solvent Pocket Book), edited by the Society of Organic Synthesis Chemistry, Japan, are preferably used in terms of solubility for resins and drying property in the manufacturing process. Solvents for use in coating solutions to form respective layers include, for example, ketones such as acetone, isophorone, ethyl amyl ketone, methyl ethyl ketone, methyl isobutyl ketone, cyclopentanone and cyclohexanone; alcohols such as methyl alcohol, ethyl alcohol, n-propyl alcohol, isopropyl alcohol, n-butyl alcohol, isobutyl alcohol, t-butyl alcohol, 2-butyl alcohol, diacetone alcohol, and cyclohexanol; glycols such as ethylene glycol, diethylene glycol, triethylene glycol and propylene glycol; ether alcohols such as ethylene glycol monomethyl ether and diethylene glycol monoethyl ether, ethers such as diethyl ether, tetrahydrofurane, 1,3-dioxolan and 1,4-dioxane; esters such as ethylacetate, n-butylacetate, isobutylacetate; hydrocarbons such as n-heptane, cyclohexane toluene and xylene; and chlorides such as methyl chloride, methylene chloride, chloroform and dichlorobenzene. Unless the object of the invention is adversely affected, solvents usable in the invention are not limited to the foregoing solvents.

The solvents are usable alone or in combination. A content of the foregoing solvents in the photothermographic materials relating to the invention can be adjusted in accordance with the temperature condition in the drying process after completion of the coating process. The residual solvent content in the photothermographic material is preferably 5 to 1000 mg/m$^2$, and more preferably 10 to 300 mg/m$^2$.

In cases when dispersing procedure is needed in the formation of coating solution, commonly known dispersing machines are optimally employed, including a two-roll mill, three-roll mil, ball mill, pebble mil, cobol mill, trone mill, sand mill, sand grinder, Sqegvari atreiter, high-speed impeller dispersant, high-speed stone mill, high-speed impact mill, disperser, high-speed mixer, homogenizer, ultrasonic dispersant, open kneader and continuous kneader.

Commonly known various coater stations are employed to coat coating solutions prepared as above on a support and examples thereof include an extrusion type extruding coater, reverse roll coater, gravure roll coater, air-doctor coater, blade coater, air-knife coater, squeeze coater, dipping coater, bar coater, transfer roll coater, kiss coater, cast coater, and spray coater. Of these coaters, an extrusion type extruding coater a roll coater such as a reverse roll coater are preferable to enhance uniformity in thickness of the layers described above.

As described above, coating and drying may be repeated for each layer. Alternatively, multi-layer coating may be conducted through a wet-on-wet system, in which the extrusion type extruding coater is used in combination with the foregoing reverse roll coater, gravure roll coater, air doctor coater, blade coater, air-knife coater, squeeze coater, dipping coater, bar coater, transfer roll coater, kiss coater, cast coater, spray coater or slide coater. In such multi-layer coating through a wet-on-wet system, the upper layer is coated on the lower layer in the wet state so that adhesion between the lower and upper layers is enhanced.

The coating solution of the image forming layer is coated and dried preferably at a temperature range of 65 to 100° C. to effectively achieve the desired effects of the invention. A drying temperature lower than 65° C. results in an insufficient reaction, often causing aging changes in sensitivity and a drying temperature higher than 100° C. results in unfavorable fogging (coloring) immediately after manufacturing the photothermographic material. The drying time, depending on air volume is not wholly defined and drying over a period of 2 to 30 min. is preferred.

Drying is conducted at the temperature within the range described above immediately after coating. Alternatively, the initial drying is conducted at a temperature lower than 65° C., followed by drying at the temperature described above for the purpose of preventing a Malangoni effect of a coating solution occurring in drying or unevenness (so-called orange skin) caused due to the fact that the portion in the vicinity of the surface initially is completely dried by hot air.

The process of winding the photothermographic material on a roll is conducted preferably in an atmosphere at an absolute humidity of 5 to 15 g/m$^2$ and a temperature of 10 to 30° C. The winding process refers to the stage of from exiting the drying process to winding the coated photothermographic material on a roll. Setting an absolute humidity at this stage within the foregoing range leads to enhanced image stability of the coated photothermographic material. An absolute humidity of less than 5 g/m$^2$ results in lowered activity of the developing agent when developed. An absolute humidity of more than 15 g/m$^2$ results in excessive development activity, leading to increased fogging in imaging areas.

Next, a package of the photothermographic material of the invention will be described. The package is a so-called room-light loading type, which contains a light-shielding leader and is loadable under room-light into an image exposure apparatus under room light under room light, as described in JP-A No. 2-72347, 11-133551 and 2001-13632.

Figure 2:
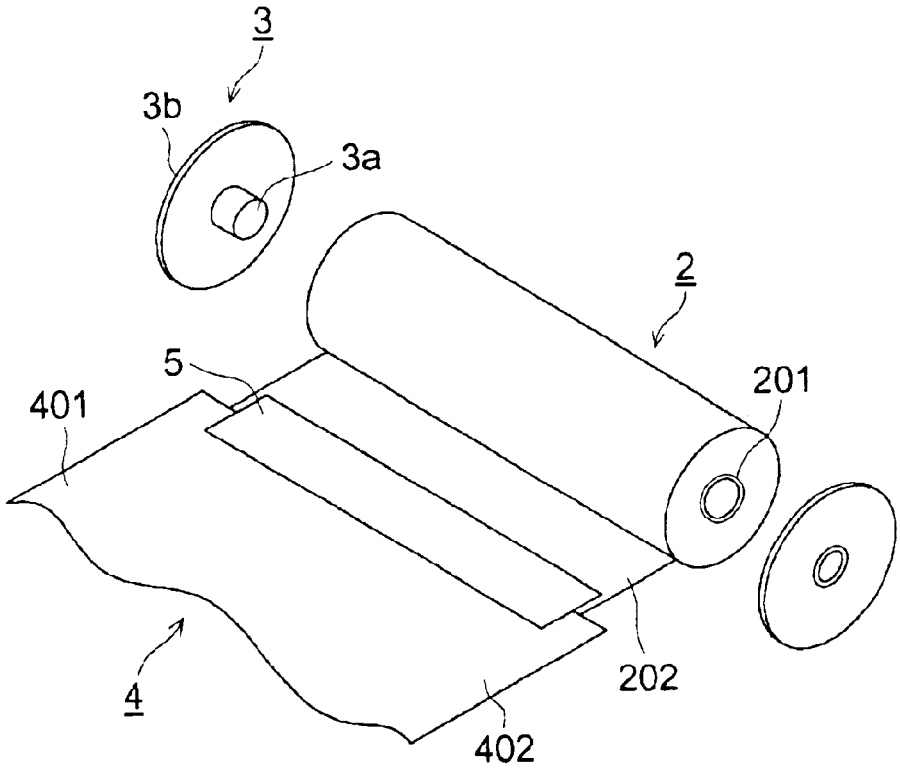
FIG. 2 is an exploded view of the package.

FIG. 1 is a perspective view of a package relating to this invention, while FIG. 2 is an exploded view thereof. In the drawings, the numeral 1 designates a room-light loading package and the numeral 2 designated a rolled photothermographic material, in which a wide and long photothermographic material is wound up on a roll core (designated 201); the numeral 3 designates a flange member having a flange section (designated 3*b*) having a circumference greater than that of the rolled photothermographic material (2), in which a cylindrical insertion section (designated 3*a*) is inserted into both ends of the roll core (201) of the rolled photothermographic material (2). The numeral 4 designates a light-shielding leader, which is attached with a bonding tape to the top portion (designated 202) of the rolled photothermographic material (2). The width of the light-shielding leader (4) is broader than that of the rolled photothermographic material (2). The numerals 401 and 402 designate an ear portion of the light-shielding leader (4) and the respective ear portions (401, 402) cover the periphery of the flange section (3*b*) when the light-shielding leader (4) is wound around the circumferential surface of the rolled photothermographic material (2). The periphery includes both outside and inside of the flange section (3*b*), covered with the light-shielding leader.

The light-shielding leader (4) has a width so that the light-shielding leader covers outwardly 3 to 10 mm from the periphery of the flange section when the light-shielding leader is wound around the circumference of the rolled photothermographic material (2) to cover peripheries at both ends. The numeral 6 designates a bonding tape fixing the termination of the light-shielding leader (4).

The light-shielding leader (4) functions as a light-shielding member to protect the circumferential surface of the rolled photothermographic material (2) from light, humidity and dust. Accordingly, any material having sufficient light-tightness, moisture resistance and physical strength and exerting no adverse influence on the photothermographic material, such as fogging is usable for the light-shielding leader. Examples thereof include laminated materials, as described in "Kinosei-Hohsozairyo no Shintenkai" (Development of Functional Packing Material, published by Toray Research Center) and JP-A No. 8-179473.

The light-shielding leader used in this invention preferably exhibits a moisture permeability of not more than 5 g/m$^2$·24 hr (at 40° C. and 90% RH), and more preferably 0 to 5 g/m$^2$·24 hr (at 40° C. and 90% RH) In cases when employing some kinds of materials exhibiting a moisture permeability exceeding 5 g/m$^2$·24 hr, a length of the light-shielding leader to be wound around the circumference of the rolled photothermographic material is increased to maintain a humidity of the invention in the interior of the package, so that when the package is loaded into the apparatus, the light-shielding leader to be pulled out becomes longer, often making it hard to use it. The moisture permeability can be determined in accordance with the method defined in JIS K7129-1992.

As packing material for the light-shielding leader are usable various kinds of materials described in "Kinosei-Hohsozairyo no Shintenkai" (Development of Functional Packing Material, published by Toray Research Center), including polyethylene resin, polypropylene resin, polyethylene terephthalate resin, polyamide resin, ethylene-vinyl alcohol copolymer resin, ethylene-vinyl acetate copolymer resin, acrylonitrile-butadiene copolymer resin, cellophane type resin, vinylon type resin, and vinylidene chloride resin. Stretched polypropylene resin and nylon resin may be used and vinylidene chloride resin coat may also be used. Further, low-density and high-density polyethylene resins are also usable. Of the foregoing polymeric materials is preferred the use of nylon (also designated as Ny), vinylidene chloride (PVDC)-coated nylon (KNy), non-stretched polypropylene (CPP), stretched polypropylene (OPP), PVDC-coated polypropylene (KOP), polyethylene terephthalate (PET), PVDC-coated cellophane (KPT), ethylene-vinyl alcohol copolymer (Evar), low-density polyethylene (LDPE), high-density polyethylene and linear low-density polyethylene. The foregoing thermoplastic resins can optionally be used in the form of multilayer film prepared by co-extrusion of different films or multiplayer film (or laminated film) prepared by lamination of films differing in stretching angle. Further, it is also possible to combine films differing in density or molecular weight distribution to obtain a physical property necessitated as a packing material.

There are also usable polymeric material of the foregoing thermo-plastic film laminated with aluminum foil and polymeric material having a vapor deposit film of inorganic compounds. Examples of the vapor deposit film include inorganic layers described in "Thin Layer Handbook" (Nippon Gakujutsu Shinkokai, page 879–901), "Vacuum Technology" (Nikkan Kogyo Shinbun, page 502–509, 612, 810), and "Vacuum Handbook" (ULVAC Nippon Shinkuh Gijutsu K.K., page 132–134). Inorganic films include metal deposit film and inorganic oxide deposit film. Examples of the metal deposit film include ZrN, SiC, TiC, $Si_3N_4$, single crystalline Si, PSG, amorphous Si, W and aluminum. Of these, aluminum deposit film is preferred. Examples of the inorganic oxide deposit film include $SiO_x$ (x: 1 or 2), $Cr_2O_3$, $Ta_2O_3$, and $Al_2O_3$. Of these, $SiO_x$ and $Al_2O_3$ are preferred in terms of film strength.

Vapor deposit films can be prepared according to commonly known methods, as described in the above-described "Vacuum Technology" and Hoso Gijutsu, vol. 129, No. 8, for example, a resistance or high frequency induction heating, electron beam (EB) method, and plasma method (PCVD). The deposit film thickness is preferably 40 to 200 nm, and more preferably 50 to 180 nm.

As a thermoplastic resin film used for a substrate of vapor deposit films, film materials commonly used for packaging films are also used, including ethylenetetrafluoroethyl copolymer (ETFE), HDPE, OPP, polystyrene (PS), polymethyl methacrylate (PMMA), bi-axially stretched nylon, (ONy), PET, polycarbonate (PC), polyimide, and polyether styrene (PES).

Multilayer films can be prepared according to commonly known methods, such as a co-extrusion method and dry-lamination method described in "Plastic Engineering Handbook" (ed. Kobunshi-gakkai, page 707–716). A multilayer film or a single film is preferably 1 to 300 $\mu$m, and more preferably 10 to 200 $\mu$m thick. Specific examples of a light-shielding leader using a multilayer film are shown below but are not limited to these, in which the layer arrangement is represent ed in the order of (outermost layer)/(intermediate layer)/lowest layer in contact with photothermographic material), $SiO_x$.PET and $Al_2O_3$.PET represent $SiO_x$ and $Al_2O_3$ deposited on PET:

(1) OPP/$SiO_x$.PET/CPP
(2) OPP/$SiO_x$.PET/PE
(3) OPP/$Al_2O_3$.PET/CPP
(4) $Al_2O_3$.PET/Ny/CPP
(5) PET/$Al_2O_3$.PET/PE
(6) KOP/Ny/PE
(7) PE/KNy/PE
(8) KPT/PE/Ny/PE
(9) OPP/CPP
(10) PET/Evar/PE
(11) OPP/Evar/PE The light-shielding leader is used by optimally selecting the shape of a package with fitting rolled photothermographic material used therein.

The use of carbon black to provide light-tightness to the light-shielding leader is preferred but it is necessary to take notice that in some carbon blacks, raw material thereof contains sulfur adversely affecting photographic material. Based on raw material, carbon black is classified into gas-furnace black, oil-furnace black, channel black, anthracene black, acetylene black, kechen carbon black, conductive carbon black, thermal black, lamp black, animal black and vegetable black. Specifically, furnace carbon black has a free sulfur content of 1 to 200 ppm, an average particle size of 10 to 120 $\mu$m, a pH of 6.0 to 9.0, an absorbed oil content of 60 to 200 ml/100 g and a volatile component of 0 to 3.0% is preferred. Carbon black is incorporated preferably in an amount of 0.05 to 20% by weight. Carbon black of less than 0.05% by weight is insufficient for prevention for light-tightness, static elimination, anti-blocking and antioxidation, and leading to an increased kneading cost. Carbon black of more than 20% by weight results in a lowered physical strength, deteriorated moldability and increased dust creation, leading black-stained the photothermographic material. In addition thereto, the moisture content is increased, resulting in not only foaming or deteriorated outer view but also increased free sulfur production at the time of molding, leading to deteriorated storage stability of the photothermographic material. Carbon black is used in the form of dry color, liquid color, paste color, master batch pellet, compound color pellet or granular color pellet. The master batch method using master batch pellets is preferred in terms of cost and anti-staining of working areas. JP-B No. 40-26196 (hereinafter, the term, JP-B refers to Japanese Patent Publication) describes a method, in which carbon black is deposited in a solution of a polymer dissolved in organic solvents to form a masterbatch of polymer and carbon black and JP-B No. 43-10362 describes a method of dispersing carbon black in a polyethylene resin to prepare a masterbatch. As light-shielding material other than carbon black are preferred pigments described in "Ganryo Binran" (Pigment Handbook, Seibundo-shinko-sha, page 175–249).

The light-shielding leader relating to this invention may further be added with various additives, such as an antistatic, slipping agent, antioxidant and lubricant.

To inhibit discharging caused between the light-shielding leader and the rolled photothermographic material, the surface specific resistance of the light-shielding leader, which is in contact with the photothermographic sheet, is preferably $1\times10^5$ to $1\times10^{13}$ Ω. A surface specific resistance of less than $1\times10^5$ Ω needs incorporation of metal powder or metal layer, resulting in an increase in cost. A surface specific resistance of more than $1\times10^{13}$ Ω results in no antistatic effect. The surface specific resistance can be determined in accordance with the method described in JIS K6911 using, for example, Tera-Ohmmeter (produced by Kawaguchi Denki Co., Ltd).

It is preferred to use antistatic agents to cause the surface specific resistance of the light-shielding leader to fall within the range described above. For example, the use of antistatic agents described in JP-A No. 62-286042 and 2000-98545 is preferred and various kinds of surfactants are employed as a preferred antistatic agent. Representative examples of a non-ionic surfactant include polyethylene glycol fatty acid esters, polyoxyethylene sorbitan fatty acid esters, polyoxyethylenealkyl ethers, polyoxyethylenealkylamines, polyoxyethylenealkylamine faty acid esters, polyoxyethylene aliphatic alcohol ethers, polyoxyethylenealkylphenyl ethers, polyoxyethyleneglycerine fatty acid esters, polyoxyethylene aliphatic amines, sorbitan monofatty acid esters, fatty acid pentaerythrit, adducts of ethyleneoxide with alcohol, adducts of ethyleneoxide with fatty acid, adducts of ethyleneoxide with aliphatic amine or fatty acid amide, adducts of ethyleneoxide with alkylphenol, adducts of ethyleneoxide with alkylnaphthol, adducts of ethyleneoxide with polyhydric alcohol and fatty acid ester, polyoxyethylene alkylamide or alkylamine derivatives and nonionic antistatic agents described in JP-B No. 63-26697. Representative examples of an anionic surfactant include ricinoleic acid sulfate ester sodium salt, metal salts of various fatty acids, sulfonated oleic acid ethylaniline, oleic acid sulfuric acid ester saltsoleyl alcohol sulfuric acid ester sodium salt, alkylsulfuric acid ester salts, fatty acid ethylsufonates, alkylsulfates, alkylphosphates, alkylsulfonates, alkylnaphthalenesulfonates, alkylbebzenesulfonates, succinic acid ester sulfonates and phosphoric acid ester salts. Repersentative examples of a cationic surfactant include primary amine salts, tertiary amine salts, quaternary ammonium salts, trialkylbenzylammonium salts, and pyridine derivatives. There are also usable various kinds of antistatic agents optimally selected from "Plastic Data Book" (Kogyochosakai, Apr. 5, 1984) page 776–778. Of the foregoing surfactants, the use of a nonionic surfactants as an antistatic agent is specifically preferred in terms of little adverse effect on photographic properties and human body.

The content of an antistatic agent is preferably 0.01 to 20%, more preferably 0.05 to 10%, and still more preferably 0.10 to 1.0% by weight. A content of less than 0.01% by weight results no effect, leading to an increase in cost for kneading. On the other hand, a content of more than 20% by weight results in no further enhanced effect, leading to an increase in cost. Further, when aged, bleed-out of ingredients increases and the surface of the package become unprofitably sticky. The method for incorporating an antistatic agent is not specified but incorporation to the light-shielding leader is preferred, for example, as described in Convertech, 1992 July, page 59–61.

Another means for avoiding static electricity is to control the surface roughness of the light-shielding leader. For example, static elimination can be achieved by control the surface roughness to the range of 5 to 100 $\mu$m (maximum height), and preferably 10 to 30 $\mu$m (maximum height). A maximum height of less than 5 $\mu$m produced no antistatic effect and a maximum height of more than 100 $\mu$m produces a thin area, deteriorating light-tightness. The method for fabricating the surface roughness within the range of 5 to 100 $\mu$m (maximum height) is not specified and for example, a method described in Plastic Fabrication Technology Handbook (Nikannkogyo), page 836–854. The surface roughness is represented by the maximum height (Ry) defined in JIS B0601, which can be determined in accordance with the method described in JIS B0601, using a measuring device, Surf Com (produced by Tokyo Seimitsu).

There are usable commonly known slipping agents. Examples thereof include silicones, oleic acid amides, erucic amides, stearic acid amides, bisOfatty acid amides, alkylamines, hydrocarbons, fatty acids, esters, and metal soaps, which are also commercially available. The slipping agent is incorporated preferably in an amount of 0.03 to 2% by weight.

Incorporation of antioxidants is preferred to inhibit production of humps and occurrence of a fish eye and to prevent coloring troubles. Commonly known antioxidants can be used, including phenol-type, ketone amine condensation-type, allyamine-type, imidazole-type, phosphite-type, thiourea-type, sulfur-type, phosphorus-type and thioether-type antioxidants, and metal inactivators. Of these, phenol-type antioxidants are specifically preferred, which are commercially available, Ireganox of Ciba-Geigy, SumilizerBHT, Sumilizer BH-76, Sumilizer WX-R, Sumilizer BP-101 of Sumitomo Chemical Ind. Co., Ltd. Further, the use of at least one of a low-volatile high-polymeric phenol-type antioxidant (Trade name: Ireganox 1010, Ireganox 1076, Topanol CA, Ionox 330, etc.), dilaulyldithiopropionate, distearylthiopropionate and dialkylphosphate is preferred and the combined use thereof is effective. The combined use of a phenol type antioxidant and a phosphorous type antioxidant results in a markedly antioxidant effect. In cases where incorporated into a polyolefin type adhesive layer or light-shielding polyolefin resin film, for example, the amount of an antioxidant to be incorporated is 0.003 to 2.0% by weight. An amount of less than 0.003% by weight substantially results in no effect. On the other hand, n amount of more than 2.0% by weight adversely affects photographic film employing a reducing action, often producing abnormal photographic performance. Accordingly, it is preferred to incorporate an antioxidant in a minimum amount not causing coloring troubles, humps and fish eyes. There can also be used antioxidants selected from those which are described in "Plastic Data Handbook" (KK Kogyochosakai) page 794–799, "Collective Plastic Additive Data" (KK Kagakukogyo-sha) page 327–329, and "PLASTICS AGE ENCYCLOPEDIA Shinpo-hen" (1986, KK Kagakukogyo-sha) page 211–212.

Examples of a plasticizer usable in this invention include phthalic acid esters, glycol esters, fatty acid esters and phosphoric acid esters.

The moisture content of the core used in this invention is preferably not more than 4% by weight, and more preferably 0% to 4% by weight. Any core is usable unless the photothermographic material is adversely affected, for example, fogged. The moisture content can be determined by the Karl Fischer method. Materials used for the core include, for example, pulp, various kinds of plastic resins, aluminum, and iron. Of these, thick pulp and plastic resins are preferred in terms of price and handling. A pulp which is externally or internally coated with synthetic resin (such as vinylidene chloride) can suitably be used. To prepare a core having a moisture content of 0 to 4% by weight, using the foregoing materials, for example, heating is conducted at 80° C. for 1 hr.

A manufacturing method of a package relating to this invention, specifically in the case of a room-light loadable package as shown in FIG. 1, will be exemplarily explained. A belt-form photothermographic material is reeled on a take-up core having a moisture content of 4 wt % or less in an atmosphere at an absolute humidity of 5 to 15 g/m$^2$ and a temperature of 10 to 30° C. to obtain a rolled photothermographic material. A light-shielding leader, which exhibits a moisture permeability of not more than 5 g/m$^2$·24 hr (at 40° C. and 90% RH) and has a width longer than that of the rolled photothermographic material, is attached to the top of the rolled photothermographic material with a piece of tape. Thereafter, a flange member larger than the diameter of the rolled photothermographic material is attached to both ends of the rolled photothermographic material and a light-shielding leader is wound around the rolled photothermographic material with applying tension so that both sides of the light-shielding leader cover the circumference of the flange, and a room-light loadable package is thus prepared. This packing procedure is conducted preferably in an atmosphere of an absolute humidity of 5 to 15 g/m$^2$ and a temperature of 10 to 30° C. An absolute humidity of less than 5 g/m$^2$ results in a reduced moisture content of the photothermographic material, often leading to deteriorated developability and a decreased image density. An absolute humidity of more than 15 g/m$^2$ results in an excessive moisture content of the photothermographic material, often producing an increased fog density. In the case of a temperature lower than 10° C., it is difficult to reach an absolute humidity of 5 g/m$^2$ or more, leading to an insufficient moisture content of the photothermographic material. A temperature higher than 30° C. easily causes reduction of silver salts to silver within the light-sensitive layer, deteriorating pre-exposure storage stability of the photothermographic material.

The atmosphere in the packing stage described above is the same even when forming a package in a different form.

The flange member (3) shown in FIG. 1 can be prepared by injection molding, vacuum molding or compression molding, in accordance with JIS K-7203. Any thermoplastic resin exhibiting a bending strength of at least 250×9.8N can be employed, and examples thereof include PS, ABS, PC, acryl, PA, PE and PP. In the case of a bending strength of less than 250×9.8N, when the package is placed on a flat plane, the flange is easily inclined, often making it difficult to cover the circumference of the flange with the light-shielding leader.

The flange is preferably 0.3 to 1.0 mm, and more preferably 0.4 to 0.8 mm thick. In the case of it being less than 0.3 mm thick, when the package is placed on a flat plane, the flange is easily inclined, exerting pressure on the rolled photothermographic material and often producing causes of troubles. A thickness of more than 1 mm results in lowered productivity in the manufacture of the flange or making it difficult to achieve a prescribed dimensional precision.

When transporting the package relating to this invention, it is preferred to enclose it in a box. Material used for the box is not specifically limited, including corrugated board and plastics. The shape of the box is also not specifically limited and shapes, for example, as described in "Saishin Kamikako Binran" (Recent Paper Engineering Technology Handbook, published by Tex Time), page 827–831, are applicable. There are used two-side, corrugated board, two-side, doubly corrugated board and two-side, triply corrugated board using a A-flute, B-flute and E-flute so as to fit the size of the included photothermographic material.

EXAMPLES

The present invention will be further described based on examples but embodiments of the invention are by no means limited to these.

Example 1

Preparation of a Subbed PET Photographic Support

Both surfaces of a biaxially stretched thermally fixed 125 μm thick, 1000 mm wide and 2000 m long PET film, produced by Teiji, was subjected to plasma treatment 1. Onto the surface of one side, the subbing coating composition a-1 descried below was applied so as to form a dried layer thickness of 0.8 μm, which was then dried. The resulting coating was designated Subbing Layer A-1. Onto the opposite surface, the subbing coating composition b-1 described below was applied to form a dried layer thickness of 0.8 μm. The resulting coating was designated Subbing Layer B-1. Subsequently, the respective sublayer surfaces were further subjected to plasma treatment 2.

Using a batch type atmospheric plasma treatment apparatus (AP-I-H-340, available from E.C. Chemical Co., Ltd.), plasma treatments 1 and 2 were conducted at a high frequency output of 4.5 kW and a frequency of 5 kHz over a period of 5 sec, in which gas was comprised of argon (90 vol %), nitrogen (5 vol %) and hydrogen (5 vol %).

| Subbing Coating Composition a-1 | |
|---|---|
| Latex solution (30% solids) of copolymer consisting of butyl acrylate (30 weight %), t-butyl acrylate (20 weight %) styrene (25 weight %) and 2-hydroxy ethyl acrylate (25 weight %) | 270 g |
| Hexamethylene-1,6-bis(ethyleneurea) | 0.8 g |
| Fine particular polystyrene (av. size 3 μm) | 0.05 |

-continued

| | |
|---|---|
| Colloidal silica (av. size 90 μm) | 0.1 g |
| Water to make | 1 liter |
| **Subbing Coating Composition b-1** | |
| Tin oxide (doped with 0.1 weight % indium, av. size 36 nm) | 0.26 g |
| Latex liquid (30% solids) of a copolymer consisting of butyl acrylate (30 weight %) styrene (20 weight %) glycidyl acrylate (40 weight %) | 270 g |
| Hexamethylene-1,6-bis(ethyleneurea) | 0.8 g |
| Water to make | 1 liter |

Thermal Fixing Treatment

In the drying stage of the subbed support, the support was heated at 140° C. and gradually cooled down, while being transported at a tension of $1\times10^5$ Pa.

A backing layer coating composition and a backing protective layer coating composition, as described below were each filtered using a filter having a semi-absolute filtration precision of 20 μm and then simultaneously coated on the antistatic-finished sublayer (B-1) of the support using an extrusion coater, so as to form a total dry layer thickness of 30 μm. Prior to coating, a polyethyleneimine was added to the backing layer coating composition or backing protective layer, as shown in Table 1. After coating, drying was conducted at 60° C. for 4 min. to obtain supports coated with a backing layer and a backing protective layer No. 101 through 114. The used polyethyleneimine was Lupasol WF (Produced by BASF).

| Backing layer coating composition | |
|---|---|
| Methyl ethyl ketone | 16.4 g/m$^2$ |
| Polyester resin (Vitel PE2200B, Bostic Co.) | 106 mg/m$^2$ |
| Cellulose acetate propiorate (CAP504-02, Eastman Chemical Co.) | 1.0 g/m$^2$ |
| Cellulose acetate butyrate (CAB381-20, Eastman Chemical Co.) | 1.0 g/m$^2$ |
| Antistatic $(CH_3)_3SiO—[(CH_3)_2SiO]_{20}—[CH_3SiO\{CH_2CH_2CH_2O(CH_2CH_2O)_{10}(CH_2CH_2CH_2O)_{15}—CH_3\})_{30}—Si(CH_3)_3]$ | 10 mg/m$^2$ |
| Fluorinated surfactant F-1 $C_8F_{17}SO_3Li$ | 10 mg/m$^2$ |
| **Backing protective layer coating composition** | |
| Methyl ethyl ketone | 22 g/m$^2$ |
| Polyester resin (Vitel PE2200B, Bostic Co.) | 106 mg/m$^2$ |
| Cellulose acetate propiorate (CAP504-02, Eastman Chemical Co.) | 1.0 g/m$^2$ |
| Cellulose acetate butyrate (CAB381-20, Eastman Chemical Co.) | 1.0 g/m$^2$ |
| Matting agent (silica, Siloid 74, Fuji Davison Co. av. size 7 μm) | 17 mg/m$^2$ |
| Antistatic $(CH_3)_3SiO—[(CH_3)_2SiO]_{20}—[CH_3SiO\{CH_2CH_2CH_2O(CH_2CH_2O)_{10}(CH_2CH_2CH_2O)_{15}—CH_3\})_{30}—Si(CH_3)_3]$ | 10 mg/m$^2$ |
| Fluorinated surfactant F-1 $C_8F_{17}SO_3Li$ | 10 mg/m$^2$ |

Preparation of Light-Sensitive Silver Halide Emulsion B

| | |
|---|---|
| Solution A1 | |
| Phenylcarbamoyl gelatin | 88.3 g |
| Compound A* (10% methanol solution) | 10 ml |
| Potassium bromide | 0.32 g |
| Water to make | 5429 ml |
| Solution B1 | |
| 0.67 mol/l Aqueous silver nitrate solution | 2635 ml |
| Solution C1 | |
| Potassium bromide | 51.55 g |
| Potassium iodide | 1.47 g |
| Water to make | 660 ml |
| Solution D1 | |
| Potassium bromide | 154.9 g |
| Potassium iodide | 4.41 g |
| Iridium chloride (1% solution) | 0.93 ml |
| Solution E1 | |
| 0.4 mol/l aqueous potassium bromide solution | |
| Amount necessary to adjust silver potential | |
| Solution F1 | |
| Aqueous 56% acetic acid solution | 16 ml |
| Solution G1 | |
| Anhydrous sodium carbonate | 1.72 g |
| Compound (A) $HO(CH_2CH_2O)_n—(CH(CH_3)CH_2O)_{17}—CH_2CH_2O)_mH$ (m + n = 5 to 7) | |

Using a stirring mixer described in JP-B Nos. 58-58288, ¼ of solution B1, the total amount of solution C1 were added to solution A1 by the double jet addition for 4 min 45 sec. to form nucleus grain, while maintaining a temperature of 45° C. and a pAg of 8.09. After 7 min, ¾ of solution B1 and the total amount of solution D1 were further added by the double jet addition for 14 min 15 sec., while mainlining a temperature of 45° C. and a pAg of 8.09. After stirring for 5 min., the reaction mixture was lowered to 40° C. and solution F was added thereto to coagulate the resulting silver halide emulsion. Remaining 2000 ml of precipitates, the supernatant was removed and after adding 10 liters water with stirring, the silver halide emulsion was again coagulated. Remaining 1500 ml of precipitates, the supernatant was removed and after adding 10 liters water with stirring, the silver halide emulsion was again coagulated. Remaining 1500 ml of precipitates, the supernatant was removed and solution G1 was added. The temperature was raised to 60° C. and stirring continued for 120 min. Finally, the pH was adjusted to 5.8 and water was added there to so that the weight per mol of silver was 1161 g, and light-sensitive silver halide emulsion B was thus obtained.

It was proved that the resulting emulsion B was comprised of monodisperse silver iodobromide cubic grains having an average grain size of 0.058 μm, a coefficient of variation of grain size of 12% and a [100] face ratio of 92%.

Preparation of Powdery Fatty Acid Silver Salt B

Behenic acid of 130.8 g, arachidic acid of 67.7 g, stearic acid of 43.6 g and palmitic acid of 2.3 g were dissolved in 4720 ml of water at 90° C. Then, 540.2 ml of aqueous 1.4 mol/l NaOH was added, and after further adding 6.9 ml of concentrated nitric acid, the mixture was cooled to 55° C. to obtain a fatty acid sodium salt solution. To the thus obtained fatty acid sodium salt solution, 45.3 g of light-sensitive silver halide emulsion A obtained above and 450 ml of water were added and stirred for 5 min., while being maintained at 55° C. Subsequently, 702.6 ml of 1M aqueous silver nitrate solution was added in 2 min. and stirring continued further for 10 min. to obtain a dispersion of fatty acid silver salt. Thereafter, the thus obtained dispersion was transferred to a washing vessel and washing with deionized water and filtration were repeated until the filtrate reached a conductivity of 2 μS/cm. Using a flush jet dryer (produced by Seishin Kigyo Co., Ltd.), the thus obtained cake-like organic silver salt was dried according to the operation condition of a hot air temperature at the inlet of the dryer until reached a moisture content of 0.1% to obtain dried powdery organic silver salt A. Hot air was obtained by heating atmospheric air by a electric heater. The moisture content was measured by an infrared ray aquameter.

Preparation of Pre-dispersing Solution B

In 1457 g of methyl ethyl ketone (also designated MEK) was dissolved 14.57 g of polyvinyl butyral resin (Butvar B-79, Monsanto Co.) and further thereto was gradually added 500 g of the powdery fatty acid silver salt B to obtain pre-dispersion B, while stirring by a dissolver type homogenizer (DISPERMAT Type CA-40, available from VMA-GETZMANN).

Preparation of Light-sensitive Dispersion B

Thereafter, using a pump, the pre-dispersion B was transferred to a media type dispersion machine (DISPERMAT Type SL-C12 EX, available from VMA-GETZMANN), which was packed 1 mm Zirconia beads (TORESELAM, available from Toray Co. Ltd.) by 80%, and dispersed at a circumferential speed of 13 m/s and for 1.5 min. of a retention time with a mill to obtain light-sensitive dispersion B.

Preparation of Solution d

In 10.1 g of methanol were dissolved 0.1 g of compound P and 0.1 g of compound Q to obtain solution d.

Preparation of Solution a

In 261 g of MEK were dissolved 107 g of a reducing agent (exemplified compound A-4) and 4.8 g of 4-methylphthalic acid to obtain additive solution a.

Preparation of Solution b

Antifoggant 2 of 11.6 g was dissolved in 137 g of MEK to obtain additive solution b.

Preparation of Solution c

Alkoxysilane compound, $C_6H_5—NH—(CH_2)—Si—(OCH_3)_3$ OF 21.7 g and 45 g of antifoggant 3 were dissolved in 159 g of MEK to obtain additive solution c.

Preparation of Solution d

Phthalazinone was dissolved in MEK so as to meet coating amounts of 0.17 g/m$^2$ and 2.73 g/m$^2$, respectively.

Preparation of Image Forming Layer Coating Solution E-1

A mixture of the foregoing light-sensitive dispersion B (1641 g) and 506 g of MEK was maintained at 21° C. with stirring and thereto, 10.75 g of antifoggant 1 (11.2% methanol solution) was added and further stirred for 1 hr. Further thereto, 13.6 g of calcium bromide (11.2% methanol solution) was added and stirred for 20 min. Subsequently, 1.3 g of solution d and stirred for 10 min., then, sensitizing dye 1 was added and stirred for 1 hr. Thereafter the temperature was lowered to 13° C. and stirring further continued for 30 min. Then, 349.6 g of polyvinyl butyral (Butvar B-79, Monsanto Co.) was added and after stirring 30 min., 95 mg of 5-methyl-2-mercaptobenzimidazole and 3.5 g of tetrachlorophthalic acid were added and stirred for 30 min. Further, 1.2 g of 5-nitroindazole, 0.4 g of 5-nitrobenzimidazole, 1.2 g of contrast-increasing agent V-1 (vinyl compound), 19 g of contrast-increasing agent H-2 (hydrazine compound) and 225 g of MEK were added. Subsequently, additive solutions a, b and d, each of 148.6 g was successively added in that order and then, 225 g of solution c was added with stirring to obtain image forming layer coating composition E-1.

Preparation of Surface Protective Layer Coating Solution

In MEK corresponding to a coating amount of 15.9 g/m$^2$ were dissolved with stirring 1.8 g of cellulose acetatebutyrate (CAV 171-15, Eastman Chemical Co.), 85 mg of polymethyl methacrylic acid (Paraloid A-21, Rohm & Haas Co.), 20 mg of bebzotriazole, 13 mg of fluorinated surfactanr F-1 ($C_8F_{17}SO_3Li$) and 50 mg of fluorinated surfactanr F-2 ($C_8F_{17}(CH_2CH_2O)_{22}C_8F_{17}$). Then, 1.75 g of the matting agent dispersion was added with stirring to obtain a coating solution of the surface protective layer.

Matting Agent Dispersion

In MEK corresponding to a coating amount of 1.7 g/m$^2$ was dissolved 50 mg of monodisperse silica particles having an average size of 3 $\mu$m and the mixture was stirred using a dissolver type homogenizer at 8000 rpm for 30 min. to obtain matting agent dispersion.

Coating of Image Forming Layer-side

The foregoing image forming layer coating solution (E-1) and protective layer coating solution were each adjusted to a viscosity of 0.228 Pa·s and 0.184 Pa·s, respectively, with varying solvent contents. After filtered with a filter of a filtration precision of 20 $\mu$m, the respective coating solutions were simultaneously coated on the sublayer A-1 of each of supports No. 101 through 114, which were provided with a backing layer and a backing protective layer, using an extrusion type die coater at a speed of 90 m/min. Prior to coating, alkoxysilane compounds were added to the image forming layer coating solution or protective layer coating solution, as shown in Table 1. After 8 sec of the coating, drying was conducted using hot air at a dry bulb temperature of 75° C. and a dew temperature of 10° C. for 5 min. and the thus dried coats were each wound up on a roll at a tension of 196 N/m (or 20 kg/m) under the environment of an absolute humidity of 8.6 g/m$^2$ and a temperature of 20° C. to obtain the rolled photothermographic material samples No. 101 through 114. The alkoxysilane compound used therein was S-1.

The thus obtained photothermographic material was comprised of an image forming layer having a silver coverage of 1.5 g/m$^2$ and a protective layer having a dry thickness of 2.5 $\mu$m.

Preparation of Package

Compound P

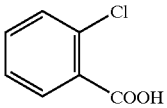

Compound Q

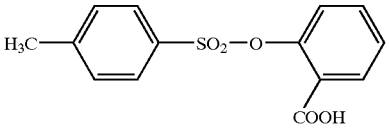

Sensitizing dye 1

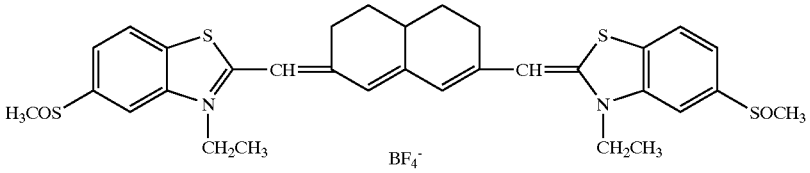

Antifoggant 2

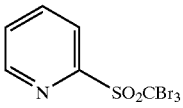

Antifoggant 3

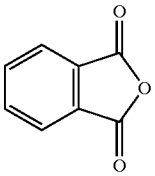

Antifoggant 1

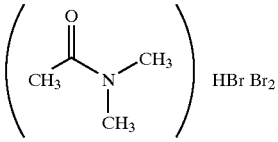

Contrast-increasing agent V-1

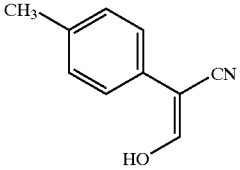

Contrast-increasing agent H-2

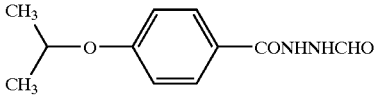

The rolled photothermographic material samples No. 101 through 114 were each cut to a width of 61 cm to prepare a room-light loadable package samples No. 101 through 114, as shown in FIG. 1, in which the light-shielding leader was wound three times around the circumference of the rolled photothermographic material. After allowed to stand for one day in a cutting room which was maintained at the prescribed temperature and humidity so as to correspond to the prescribed absolute humidity of the inside of the package, the respective photothermographic material samples 101 through 114 were cut. Roll cores, flanges, light-shielding leader paper and a boding tape used in the preparation of the package were also allowed to stand there.

Materials shown below were used to prepare the respective package samples:

Roll core: paper core of 2.0 mm thick and 76 mm diameter,

Flange: 0.8 mm thick polystyrene flange, added with furnace carbon black by the master batch method, Light-shielding leader: light-proof laminated film, obtained by the dry lamination method (OPP 80 $\mu$m/$SiO_x$.PET 80 $\mu$m/CPP 80 $\mu$m.

In the light-shielding leader, furnace carbon black was incorporated to OPP of the upper layer and CPP of the lower layer by the master batch method to provide light-tightness. The moisture permeability was 3.2 g/m$^2$·24 hr (at 40° C. and 80% RH), which was determined in accordance with the method described in JIS K7129-1992. The absolute humidity of the inside of the package was a valuecalculated from the absolute humidity and relative humidity which were measured using Thermo Recorder TR-72S and temperature-humidity sensor TR-3110 (available from T & D Co.).

Evaluation

After allowed to stand at 35° C. and 80% RH for 3 days, samples 101 through 114 exposed through an optical wedge and thermally processed, and evaluated with respect to maximum density (designated Dmax), minimum density (Dmin) and dot for dot reproduction. Results thereof are shown in Table 1. Thus, samples were each cut to 25 cm×25 cm and exposed through an optical wedge at 23° C. and 50% RH using a sensitometer having 780 nm semiconductor laser. Thermal processing was carried out using a film processor (model 2771, Imation Corp.) at 120° C. for 48 sec. Exposure and thermal processing were conducted in the room conditioned at 23° C. and 50% RH.

Evaluation of Dmax and Dmin

Thermally processed photothermographic material samples were subjected to densitometry to determine the maximum density (Dmax) and minimum density (Dmin) using a densitometer (produced by X-rite) and evaluated based on the following criteria. Thus, the Dmax of not less than 4.0 is acceptable in practical use (denoted as Superior or simply as "S") and the Dmax of less than 4.0 is unacceptable in practical use (denoted as Inferior or simply as I); the Dmin of less than 0.11 is acceptable in practical use (denoted as "S") and the Dmin of not less than 0.11 is unacceptable in practical use (denoted as "I").

Evaluation of Halftone Dot Reproducibility

When exposed so that a 5% halftone dot was reproduced, reproducibility of a 90% dot was evaluated based on dot percentage obtained. Thus, the dot percentage corresponding to 90% dot was determined for each sample using a densitometer (produced by X-rite). The closer to 90% indicates better dot reproducibility. Dot reproducibility was evaluated based on the following criteria, i.e., dot reproduction falling within 90±1% is acceptable (denoted as Superior or simply as "S") and dot reproduction not falling within 90±1% is unacceptable (denoted as Inferior or simply as "I").

TABLE 1

| | Polyethyleneimine | | Alkoxysilane | | | Imaging Performance | | | |
|---|---|---|---|---|---|---|---|---|---|
| Sample No. | Layer | Content (mg/m$^2$) | Layer | Content (mg/m$^2$) | Humidity*1 (g/m$^3$) | Dmax | Dmin | Dot Reproduction | Remark |
| 101 | — | — | — | — | 8.6 | I | I | I | Comp. |
| 102 | — | — | C | 800 | 8.6 | S | I | I | Comp. |
| 103 | A | 30 | — | — | 8.6 | I | S | I | Comp. |
| 104 | A | 1 | C | 800 | 8.6 | S | S | S | Inv. |
| 105 | A | 30 | C | 800 | 8.6 | S | S | S | Inv. |
| 106 | A | 50 | C | 800 | 8.6 | S | S | S | Inv. |
| 107 | A | 80 | C | 800 | 8.6 | S | S | S | Inv. |
| 108 | A | 100 | C | 800 | 8.6 | S | S | S | Inv. |
| 109 | A | 30 | C | 100 | 8.6 | S | S | S | Inv. |
| 110 | A | 30 | C | 500 | 8.6 | S | S | S | Inv. |
| 111 | A | 30 | C | 1000 | 8.6 | S | S | S | Inv. |
| 112 | B | 30 | C | 800 | 8.6 | S | S | S | Inv. |
| 113 | B | 30 | D | 800 | 8.6 | S | S | S | Inv. |
| 114 | A | 30 | D | 800 | 8.6 | S | S | S | Inv. |

*1Absolute humidity in the inside of package
A: Backing protective layer
B: Backing layer
C: Image forming layer
D: Protective layer

Example 2

Sample No. 201 through 205 was prepared similarly to Sample No. 105 in Example 1, except that the absolute humidity in the inside of the package was changed as shown in Table 2. Thus, after allowed to stand for one day in the room maintained at a temperature and relative humidity corresponding to a prescribed absolute humidity in the inside of a package, the rolled photothermographic material was cut to prepare Samples No. 2-1 through 205.

Samples were evaluated similarly to Example 1. Results thereof are shown in Table 2.

TABLE 2

| | Polyethyleneimine | | Alkoxysilane | | | Imaging Performance | | | |
|---|---|---|---|---|---|---|---|---|---|
| Sample No. | Layer | Content ($mg/m^2$) | Layer | Content ($mg/m^2$) | Humidity*1 ($g/m^3$) | Dmax | Dmin | Dot Reproduction | Remark |
| 201 | A | 30 | C | 800 | 3 | I | S | I | Comp. |
| 202 | A | 30 | C | 800 | 4 | S | S | S | Inv. |
| 203 | A | 30 | C | 800 | 10 | S | S | S | Inv. |
| 204 | A | 30 | C | 800 | 17 | S | S | S | Inv. |
| 205 | A | 30 | C | 800 | 18 | S | I | I | Comp. |

A: Backing protective layer
B: Backing layer
C: Image forming layer
D: Protective layer

Example 3

Backing supports No. 301 through 311 were prepared similarly to Example 1, provided that a backing layer and backing protective layer containing a polyethyleneimine compound and an alkoxysilane compound, as shown in Table 2 were simultaneously coated on the subbed support used in Example 1. The polyethyleneimine compound was Lupasol WF (produced by BASF) and the alkoxysilane compound was S-1.

Using the thus prepared supports No. 301 through 311, an image forming layer coating solution (E-1) and a protective layer coating solution used in Example 1 were coated on the sublayer (A-1) of the support and rolled similarly to Example 1 to prepared photothermographic materials No. 301 through 311, provided that an alkoxysilane compound was not incorporated into the image forming layer.

The rolled photothermographic materials were each cut to a width of 61 cm and package samples No. 301 through 311 were prepared similarly to Example 1, except that the absolute humidity in the inside of the package was made to 8.6 $g/m^3$. The thus prepared samples were evaluated similarly to Example 1 and the results thereof are shown in Table 3.

TABLE 3

| | Polyethyleneimine | | Alkoxysilane | | | Imaging Performance | | |
|---|---|---|---|---|---|---|---|---|
| Sample No. | Layer | Content ($mg/m^2$) | Layer | Content ($mg/m^2$) | Humidity*1 ($g/m^3$) | Dmax | Dmin | Dot Reproduction |
| 301 | A | 40 | A | 100 | 8.6 | S | S | S |
| 302 | A | 40 | A | 400 | 8.6 | S | S | S |
| 303 | A | 40 | A | 800 | 8.6 | S | S | S |
| 304 | A | 40 | A | 1000 | 8.6 | S | S | S |
| 305 | A | 30 | B | 800 | 8.6 | S | S | S |
| 306 | B | 30 | A | 800 | 8.6 | S | S | S |
| 307 | B | 1 | B | 800 | 8.6 | S | S | S |
| 308 | B | 10 | B | 800 | 8.6 | S | S | S |
| 309 | B | 50 | B | 800 | 8.6 | S | S | S |
| 310 | B | 70 | B | 800 | 8.6 | S | S | S |
| 311 | B | 100 | B | 800 | 8.6 | S | S | S |

A: Backing protective layer
B: Backing layer

Example 4

On the subbed support used in Example 1, a backing layer and a backing protective layer were coated similarly to Example 1, except that a polyethyleneimine compound was not incorporated.

Using the thus prepared support, an image forming layer coating solution (E-1) and a protective layer coating solution used in Example 1 were coated on the sublayer (A-1) of the support and rolled similarly to Example 1 to prepared photothermographic materials No. 401 through 412, provided that an alkoxysilane compound and a polyethyleneimine compound, as shown in Table 4 were incorporated into the image forming layer or the protective layer.

The rolled photothermographic materials No. 401 through 412 were each cut to a width of 61 cm and package samples No. 401 through 412 were prepared similarly to Example 1, except the absolute humidity in the inside of the package was made to 8.6 $g/m^3$. The thus prepared samples 401 through 412 were evaluated similarly to Example 1 and the results thereof are shown in Table 4.

TABLE 4

| Sample No. | Polyethyleneimine Layer | Polyethyleneimine Content ($mg/m^2$) | Alkoxysilane Layer | Alkoxysilane Content ($mg/m^2$) | Humidity*1 ($g/m^3$) | Imaging Performance Dmax | Imaging Performance Dmin | Imaging Performance Dot Reproduction |
|---|---|---|---|---|---|---|---|---|
| 401 | C | 1 | C | 700 | 8.6 | S | S | S |
| 402 | C | 5 | C | 700 | 8.6 | S | S | S |
| 403 | C | 40 | C | 700 | 8.6 | S | S | S |
| 404 | C | 60 | C | 700 | 8.6 | S | S | S |
| 405 | C | 100 | C | 700 | 8.6 | S | S | S |
| 406 | C | 50 | D | 800 | 8.6 | S | S | S |
| 407 | D | 50 | C | 800 | 8.6 | S | S | S |
| 408 | D | 40 | D | 100 | 8.6 | S | S | S |
| 409 | D | 40 | D | 300 | 8.6 | S | S | S |
| 410 | D | 40 | D | 500 | 8.6 | S | S | S |
| 411 | D | 40 | D | 800 | 8.6 | S | S | S |
| 412 | D | 40 | D | 1000 | 8.6 | S | S | S |

C: Image forming layer
D: Protective layer

What is claimed is:

1. A photothermographic material comprising a support, an organic silver salt, a light-sensitive silver halide, a reducing agent and a contrast-increasing agent, wherein the photothermographic material further comprises a secondary or tertiary amino group-containing alkoxysilane compound and a polyethyleneimine and the photothermographic material is provided on one side of the support with an image forming layer and a protective layer and on the other side of the support with a backing layer and a backing protective layer, and the backing layer or the backing protective layer containing said polyethyleneimine at 1 to 100 $mg/m^2$.

2. The photothermographic material of claim 1, wherein said alkoxysilane compound is represented by the following formula (1a) or (1b):

Formula (1a)

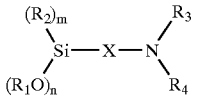

Formula (1b)

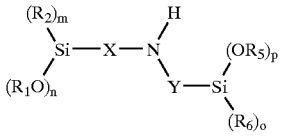

wherein X and Y are each a straight chain or branched bivalent saturated hydrocarbon group having 1 to 10 carbon atoms; $R_1$, $R_2$, $R_5$ and $R_6$ are each a straight chain or branched saturated hydrocarbon group having 1 to 4 carbon atoms; $R_3$ and $R_4$ are each a hydrogen atom, an aliphatic group having 1 to 20 carbon atoms or an aromatic group, provided that at least one of $R_3$ and $R_4$ is an aliphatic group having 1 to 20 carbon atoms or an aromatic group, or $R_3$ and $R_4$ combine with each other to form a ring; m and o are each 0 or 1, n and p are each 2 or 3.

3. The photothermographic material of claim 1, wherein the image forming layer contains said alkoxysilane compound at 100 to 1000 $mg/m^2$.

4. The photothermographic material of claim 1, wherein the protective layer contains said alkoxysilane compound at 100 to 1000 $mg/m^2$.

5. The photothermographic material of claim 1, wherein the image forming layer or the protective layer contains said alkoxysilane compound at 100 to 1000 $mg/m^2$ and said polyethyleneimine at 1 to 100 $mg/m^2$.

6. The photothermographic material of claim 1, wherein the backing layer or the backing protective layer contains said alkoxysilane compound at 100 to 1000 $mg/m^2$.

7. A package of a rolled photothermographic material, wherein the package comprises a rolled photothermographic material in which a photothermographic material as claimed in claim 1 is wound on a light-shielding roll core, a light-shielding flange member provided at both ends of the roll core and a light-shielding leader which is attached to the top of the photothermographic material and has a width greater than that of the rolled photothermographic material and a prescribed length of the light-shielding leader is wound around the rolled photothermographic material with covering a circumferential portion of the flange so that light-shielding is performed with maintaining an internal absolute humidity at 4 to 17 $g/m^3$ under an environment of 10 to 25° C.

8. The package of claim 7, wherein said light-shielding leader exhibits a moisture permeability at 40° C. and 90% RH of 5 $g/m^2 \cdot 24$ hr or less.

9. The package of claim 7, wherein said core has a moisture content of 4% by weight or less.

10. The package of claim 7, wherein the photographic material is rolled on the core in an atmosphere of an absolute humidity of 5 to 15 $g/m^2$ and a temperature of 10 to 30° C.

* * * * *